US007591405B2

(12) United States Patent
Daniels

(10) Patent No.: US 7,591,405 B2
(45) Date of Patent: Sep. 22, 2009

(54) ROLL MOUNTED BAGS AND DISPENSERS FOR SAME

(76) Inventor: Mark E. Daniels, 250 No. Harbor Dr., Suite 311, Redondo Beach, CA (US) 90277

( * ) Notice: Subject to any disclaimer, the term of this patent is extended or adjusted under 35 U.S.C. 154(b) by 0 days.

(21) Appl. No.: 12/189,047

(22) Filed: Aug. 8, 2008

(65) Prior Publication Data

US 2009/0008422 A1 Jan. 8, 2009

Related U.S. Application Data

(60) Continuation-in-part of application No. 11/836,566, filed on Aug. 9, 2007, now Pat. No. 7,424,963, which is a division of application No. 11/552,629, filed on Oct. 25, 2006, now Pat. No. 7,270,256, which is a division of application No. 10/193,974, filed on Jul. 12, 2002, now abandoned.

(51) Int. Cl.
*B26F 3/02* (2006.01)
*B65H 35/10* (2006.01)

(52) U.S. Cl. ..... 225/93; 225/51; 225/96; 225/106; 248/175

(58) Field of Classification Search ..... 225/61, 225/66, 69, 78–80, 88, 90, 93–96, 106; 221/1, 221/45, 48, 50, 51, 63; 206/389, 390, 407, 206/554; 383/8, 9, 37, 121–127, 200; 248/118, 248/127, 175; 242/160.4, 419.8, 421.8, 421.9, 242/422.5, 598.5; D6/515–523
See application file for complete search history.

(56) References Cited

U.S. PATENT DOCUMENTS 690,165 A * 12/1901 Leonhard ..... 225/89
D263,009 S * 2/1982 O'Keefe ..... D6/523
4,750,694 A * 6/1988 Bateman ..... 248/175
D317,385 S * 6/1991 Wolff et al. ..... D6/522
5,209,371 A * 5/1993 Daniels ..... 221/63
5,480,084 A * 1/1996 Daniels ..... 225/106
5,556,019 A * 9/1996 Morris ..... 225/96
5,636,809 A * 6/1997 Koch ..... 242/422.5
5,706,993 A * 1/1998 DeMatteis ..... 225/106
5,727,721 A * 3/1998 Guido et al. ..... 225/106
5,934,535 A * 8/1999 Kannankeril et al. ..... 225/106
6,135,281 A * 10/2000 Simhaee ..... 206/390
6,431,396 B1 * 8/2002 Daniels et al. ..... 221/45

(Continued)

*Primary Examiner*—Jason Daniel Prone
(74) *Attorney, Agent, or Firm*—David A. Belasco; Belasco Jacobs & Townsley, LLP

(57) ABSTRACT

A wire frame plastic bag dispenser includes an angled lower bag roll support urging perforated, rolled plastic bags toward a bag roll restraining element attached to the frame. A constraining movement element prevents lateral movement of the bag roll. A perforation parting means separates bags as they are pulled from the roll. The bags may be folded along at least one vertical axis to form a more compact bag roll and may have a chisel cut in the perforation to aid in separation by the perforation parting means. The frame includes four corners each of approximately 90 degrees, has a C shape in a horizontal plane, and includes a dispensing end, a back end, and two sides. The lower bag roll support includes a proximal end attached to the back end and extends downwardly to a distal end. The perforation parting means may be located outwardly from the dispensing end of the frame.

18 Claims, 25 Drawing Sheets

U.S. PATENT DOCUMENTS 6,446,811 B1 * 9/2002 Wilfong, Jr. ..... 206/554
6,481,594 B1 * 11/2002 Yeh et al. ..... 221/63
6,488,222 B1 * 12/2002 West et al. ..... 242/160.4
6,685,075 B1 * 2/2004 Kannankeril ..... 225/96
7,270,256 B2 * 9/2007 Daniels ..... 225/93
D552,901 S * 10/2007 Wilfong et al. ..... D6/515
7,424,963 B2 * 9/2008 Daniels ..... 225/93
2002/0160896 A1 * 10/2002 Yeh et al. ..... 383/8
2003/0098326 A1 * 5/2003 Wile ..... 225/77
2004/0007607 A1 * 1/2004 Daniels ..... 225/93
2004/0217122 A1 * 11/2004 Trinko et al. ..... 221/47
2005/0035135 A1 * 2/2005 Sasian ..... 221/70
2005/0098600 A1 * 5/2005 Yeh et al. ..... 225/93
2007/0051771 A1 * 3/2007 Daniels ..... 225/93
2008/0041908 A1 * 2/2008 Daniels ..... 225/93

* cited by examiner

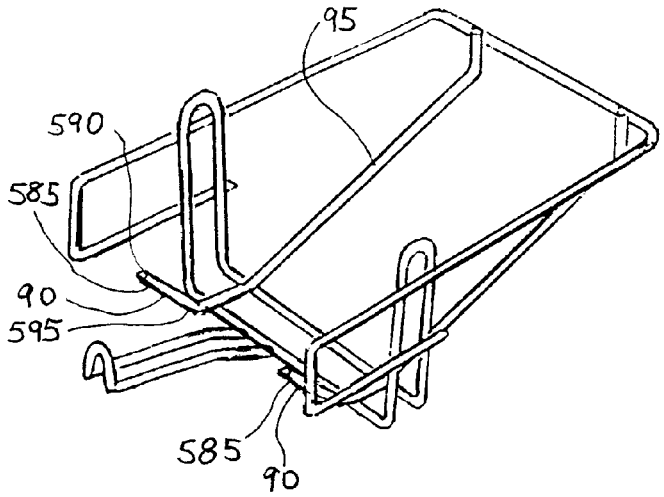
FIG. 10
FIG. 11
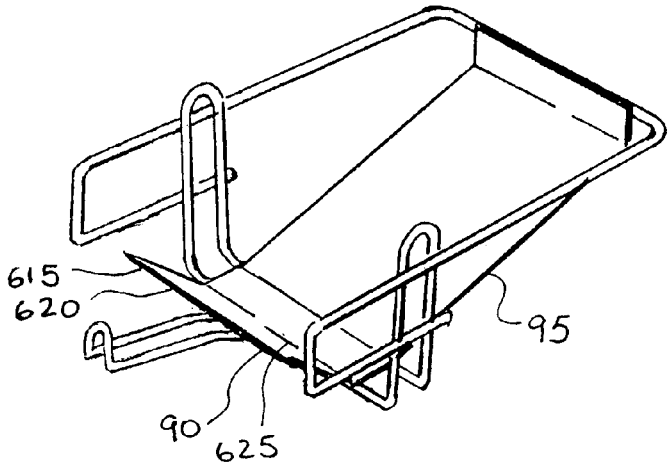
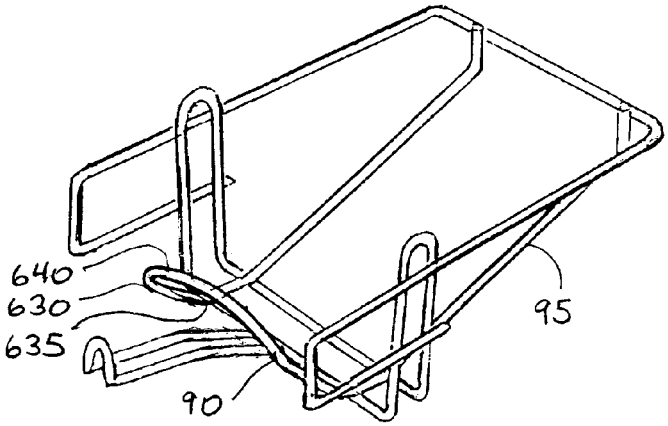
FIG. 12

FIG. 22
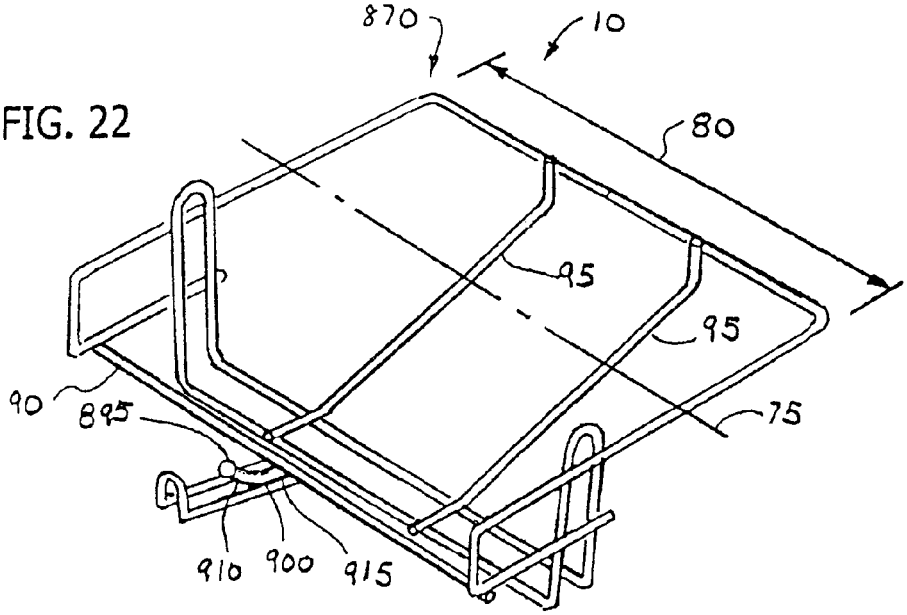
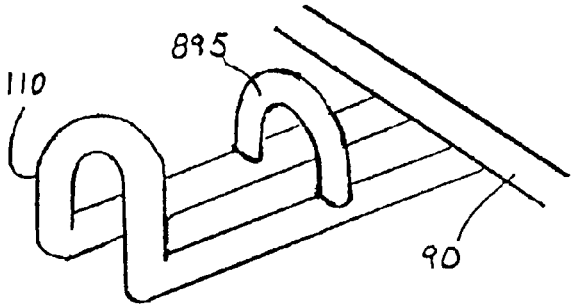
FIG. 25
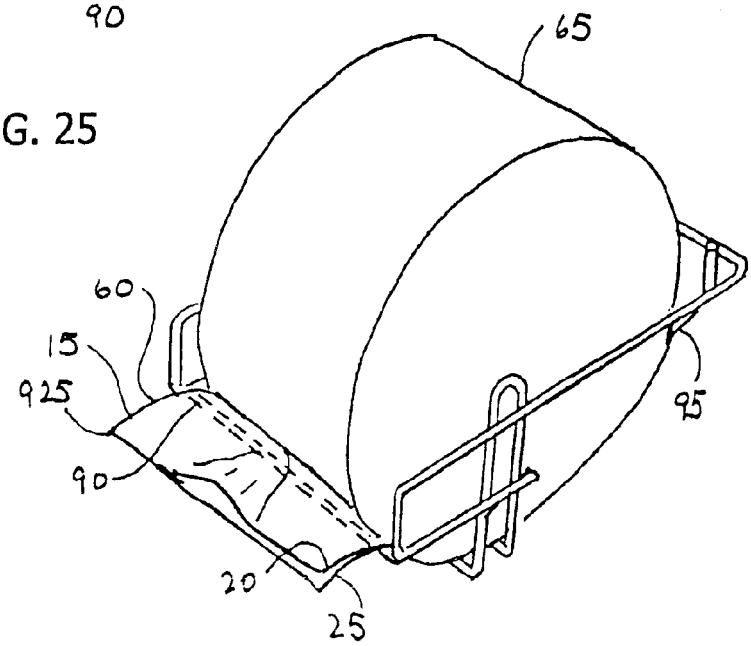
FIG. 23

ROLL MOUNTED BAGS AND DISPENSERS FOR SAME

RELATED APPLICATIONS

The instant application is a Continuation-in-Part of U.S. application Ser. No. 11/836,566, filed on Aug. 9, 2007, now U.S. Pat. No. 7,424,963 which is a Divisional Application of U.S. application Ser. No. 11/552,629, filed on Oct. 25, 2006, now U.S. Pat. No. 7,270,256 which is a Divisional Application of U.S. application Ser. No. 10/193,974, filed on Jul. 12, 2002 now abandoned.

FIELD OF INVENTION

The invention pertains to plastic bags and means for storing and dispensing such bags. More particularly, the invention relates to expandable plastic film bags designed for roll dispensing.

BACKGROUND OF THE INVENTION

Plastic bags are commonly used in supermarkets, department stores and similar applications. These bags have advantages in that they are relatively inexpensive to produce, provide substantial carrying capacity and may include easily used handles. The bags may be dispensed from flat packs or from dispensers for bags wound on rolls. Several problems are typically encountered when thin, flexible bags are used for bagging fresh produce and similar items.

Thin plastic bags tend to stick together and the mouths of the bags tend to be difficult to open. When the bags are dispensed from flat packs, they can easily become disordered and often more than one bag is taken when it is desirable to select only one. When bags are dispensed from a roll, the leading bag can become stuck to the bag roll making it difficult to remove. Various designs for dispensers for roll mounted bags have been developed to control the flow of bags from the roll so that this problem is minimized.

Other designs have been developed to assist in the identification and opening of the bag mouth as the bags are withdrawn from the roll. Typically, bags wound on rolls are joined with a perforation at each end. If adequate means are not provided for severing these perforations, multiple bags can be dispensed requiring the user to then separate them manually. A number of different design have been developed for efficiently separating the bags from each other at the perforation line. Another problem often encountered with roll mounted bag dispensers relates to control of the spinning bag roll during dispensing. If the rotation of the bag roll is not adequately controlled the bag roll will overspin and several bags be dispensed without separation, potentially tangling the dispenser. For this reason, an effective bag roll braking device is desirable.

One solution to these problems is to fold the bags longitudinally and wind them on rolls and to provide a dispenser that controls the spinning of the bag roll and provides means for separating the bags while opening the bag mouths. The present invention addresses bag-dispensing systems of this configuration.

The inventor has discovered that materials used for the construction of dispensers for roll mounted bags can have a significant effect upon the suitability of the dispensing system for different environments. Traditionally, such dispensing racks have been fabricated from steel wire and plate that is then chrome plated or painted. Such construction has the advantage of rigidity and longevity, but is also subject to rust and corrosion in damp environments. In addition, such dispensers are heavy and relatively expensive to produce. To address these problems associated with steel and other metal dispensing racks, the inventor has turned to modem, high strength plastics for rack construction. For the purposes of this application, it should be understood that "wire" should be accorded it broadest reasonable reading. Wire need not be conductive, made of metal or have a solid core. In some embodiments chrome or nickel plated metal will be desirable, in other embodiments polymer coated metal, or non-metallic wire such as polyoxymethylene, also known as polyacetal, acetal resin, polytrioxane, polyformaldehyde, commonly known as DuPont Delrin®, may be used. Structural rigidity, porosity and resistance to moisture absorption are important criteria in selecting the appropriate materials. Any material now known or later discovered, possessing sufficient rigidity, and not susceptible to significant moisture absorption may be used. Material specifically contemplated by the inventor include, without limitation, high density polyethylene (HDPE), high molecular weight polyethylene, polycarbonate; sold under such trade names as Lexan®, Markrolon® and Calibre®, acrylonitrile butadiene styrene, known as ABS, and polyamide 66, also know as DuPont Nylon 66® or Zytel®. For purposes of this application, the term wire will be understood to include materials made from ferrous and non-ferrous metals, coated and uncoated, and various polymeric materials such as plastics, including but not limited to, those described above.

Food borne pathogens can be a significant source of illness. The inventor has recognized the possibility that food borne pathogens may reside on packaging and packaging dispensers. Dispensers may go many months between cleanings. The inventor has discovered that antimicrobial additives can be incorporated with plastic resins during compounding. These additives serve as an antimicrobial, limiting growth of a wide spectrum of microbes. The inventor also contemplates using antimicrobial-additive coatings, which can be applied to existing dispensers.

Various designs have been developed for roll mounted bags and dispensers for such bags, incorporating a number of different technologies.

U.S. Pat. No. 5,752,666 issued to Simhaee discloses a roll of plastic bags wound on a core in a star-sealed configuration for use with a dispenser having opposing tracks in which the roll is supported. The dispenser has a separating tongue for enabling individual bags to be separated from the roll. Separation lines are provided between adjacent bags, a slot in each separation line being engageable by the tongue within the dispenser so that individual bags may be dispensed from the roll one at a time.

U.S. Pat. No. 5,556,019 issued to Morris, describes a bag separator and dispenser for use with bags wound on a core and separated by perforation lines at each end of the bags. The perforation lines include a slot that is collinear with the perforations and is used to engage a separator projection. The projection enters the slot as the bags are pulled from the roll. The dispenser includes two braking devices to control the removal of bags from the roll, a braking bar underneath the roll of bags and a pair of fingers that are attached to the channel for the core and are designed to engage the core as the number of bags on the roll decreases.

U.S. Pat. No. 5,135,134, issued to Dancy discloses a deformable plastic bag dispenser for a continuous roll of plastic bags. The dispenser is cylindrical in shape and includes a longitudinal slot for dispensing the bags. Adjacent bags on the roll are attached by a perforated tear line. The dispenser is deformable to allow the operator to grip the roll by squeezing the dispenser, preventing further rotation of the roll, and allowing a bag to be removed from the roll.

U.S. Pat. No. 5,307,969 issued to Menendez describes a system for facilitating the sequential dispensing of individual bags from a roll, each bag having perforations along the leading edge to facilitate its separation from the next following bag and an elongated slit centrally located between the perforations. A dispenser is provided for receiving and supporting the roll of bags comprising a housing of a generally semi-cylindrical configuration. The housing has an interior end and an exterior end, a transverse opening formed in the housing at its interior end, a transverse slot formed in the housing at its exterior end, with the transverse slot separating the housing into an upper portion and a lower portion. Lips are formed in the upper portion and the lower portion of the housing on opposite sides of the slot with the lips curved in a direction opposite from the curvature of the remainder of the housing. A finger is formed in the center of the slot extending upwardly from the lower portion adapted to receive a slit in the region between adjacent bags. A recess is formed in the center of the slot extending upwardly in the upper portion of the housing adapted to receive the finger. Flanges extend outwardly from the dispenser adjacent to the transverse opening and a bracket is adapted to receive and support the dispenser.

U.S. Pat. No. 5,921,390 issued to Simhaee is directed to a multi-ply plastic bag from a continuous strip of bags on a roll that is supplied to a user with the top of the bag partially opened. A tear line between the bottom of a leading bag and a top of a subsequent bag separates the individual bags. A broad slit centrally located in the tear line passes through all but one ply of the strip of bags. The bag dispenser has an upwardly projecting tongue that engages the slit in the tear line when a user draws a bag from the dispenser. The tongue impedes the subsequent bag from moving forward. The adjacent bags separate along the tear line. The ply that does not have a slit rides over the tongue and pulls apart the plies at the opening of the subsequent bag before the leading bag completely separates from the subsequent bag.

U.S. Pat. No. 5,480,084, issued to Daniels, the present inventor, discloses a rack for dispensing plastic bags from a roll of bags joined end-to-end and separated by a line of perforations and either an opening or a rupturable central area between the bags along the perforation line. The rack comprises a rectangular cradle to hold the roll for removal of bags by unrolling them over a horizontal side element and past a pair of snagging elements which intercept the rupturable central area to restrain each ensuing bag as the preceding bag is pulled away from the roll. This enables the preceding bag to be separated from the ensuing bag along the perforated and open or rupturable central area line. Provision is made to enable the cradle to be mounted either on or under a store counter, or against a wall.

U.S. Pat. No. 5,573,168 issued to Kannankeril et al. describes a dispensing apparatus for serially dispensing plastic bags from a wound roll of continuous flexible plastic bags joined along perforated severance lines. A box like container is provided which is adapted to receive the wound roll of plastic bags. The container has a bottom panel, a top panel, a rear panel, a front panel, and a pair of opposed side panels. The front panel defines a guide slot for guiding the plastic bags from the wound roll along a predetermined path and further defining a threading slide for threading the plastic bags from the wound roll into the guide slot. A separation tongue is located on the front panel for separating the plastic bags from the wound roll as the plastic bags engage the separation tongue along a predetermined path of travel.

U.S. Pat. No. 5,813,585 also issued to Kannankeril et al. discloses a dispensing apparatus for serially dispensing plastic bags from a wound roll of plastic bags joined along perforated severance lines. A container is provided which is adapted to receive the wound roll of plastic bags. The container has a bottom, a pair of opposed sides having an inwardly facing flange extending therefrom, and a separating tongue projecting outward from the bottom. The flanges define a self-threading slide for threading the plastic bags from the wound roll along a predetermined path onto the separating tongue. The separating tongue separates the plastic bags from the wound roll as the plastic bags engage the separation tongue along a predetermined path of travel. A mounting bracket cooperates with the bottom to mount the container to a solid surface in a plurality of different positions while maintaining the desired orientation of the container, to ensure that the wound roll is biased against the bottom and the flanges for self-braking of the wound roll and for limiting overspinning thereof as plastic bags are serially separated therefrom.

It is an objective of the invention to provide a means for dispensing thin, flexible plastic bags while minimizing the space required for such dispensing. It is a further objective to provide a dispenser that reliably presents bags for individual dispensing and efficiently separates bags from each other at the perforation line. It is another objective of the invention to provide a dispenser that opens the bag mouth of the bags as they are dispensed. It is still another objective to provide for bag dispensers that can be mounted in a variety of different ways to suit the needs of particular store configurations. It is yet another objective to provide dispensers that do not require bags to be rolled onto cores. It is still another objective to provide a dispenser that is easy to clean and to refill. Finally, it is an objective of the invention to provide dispensers that can be easily and quickly loaded with new bag rolls without difficult threading of the leading bag on the roll.

While other variations exist, the above-described designs for roll mounted bags and dispensers are typical of those encountered in the prior art. While some of the objectives of the present invention are disclosed in the prior art, none of the inventions found include all of the requirements identified.

SUMMARY OF THE INVENTION

The present invention addresses may of the deficiencies of bag and dispenser combination inventions and satisfies all of the objectives described above.

A combination of rolled plastic bags and dispenser therefore having the desired features may be constructed from the following components. A plurality of plastic bags is provided. Each of the bags has first and second parallel linear side edges, a top edge and a bottom edge. The bags are joined along a perforated severance line between the bottom edge of a first bag and the top edge of a subsequent bag. The bags are folded along at least one axis parallel to the first and second parallel linear side edges. The bags are rolled about a horizontal axis to form a compact bag roll from which the bags are dispensed. The compact bag roll has a first predetermined width.

A dispenser is provided. The dispenser includes a wire frame and a bag roll restraining means. The bag roll restraining element extends across at least a portion of the first predetermined width. The bags exit the dispenser above the bag roll restraining means. A lower bag roll support is provided. A restraining means support is provided. The restraining means support locates the bag roll restraining means above a lowest portion of the lower bag roll support. The lower bag roll support has a proximal end and a distal end, is located below the horizontal axis at the distal end and is shaped so as to urge the compact bag roll toward the restraining means. A positioning element is provided. The positioning element locates the proximal end of the lower bag roll support above the horizontal axis. A constraining movement element is provided for constraining movement of the compact bag roll along the horizontal axis. A perforation parting means is provided. The perforation parting means is sized, shaped and located to engage the perforated severance line of bags pulled from the compact bag roll. The compact bag roll has a lowest point.

The compact bag roll is located within the dispenser with the first bag of the roll extendable over the perforation parting means. When the compact bag roll is located within the dispenser with the first bag accessible for withdrawal from the dispenser, subsequent bags may be serially withdrawn from the roll with each subsequent bag parted at the perforated severance line.

In a variant of the invention, a means for directing the bags from the bag roll over the perforation parting means is provided.

In another variant, the perforation parting means extends outwardly beyond the restraining means.

In yet another variant, each bag is a T-shirt style bag. Each bag has a front panel and a rear panel. Each front panel has first and second parallel linear side edges, a top edge and a bottom edge. Each rear panel has first and second parallel linear side edges, a top edge and a bottom edge.

Each T-shirt style bag has two front gusset panels of a first predetermined dimension. Each front gusset panel has a top edge, a bottom edge, first and second parallel side edges. Each front gusset panel is joined at the first side edge to one of the linear side edges of the front panel and extends from the top edge of the front panel to the bottom edge thereof. Each bag has two rear gusset panels of the first predetermined dimension. Each rear gusset panel has a top edge, a bottom edge, first and second parallel side edges. Each rear gusset panel is joined at the first side edge to one of the linear side edges of the rear panel and extends from the top edge of the front panel to the bottom edge thereof.

Each front gusset panel also is joined to a respective one of the rear gusset panels at its second side edge. Each of the front and rear gusset panels is folded inwardly relative to the front and the rear panels. The top edges of the front panel, the rear panel, the front gusset panels and the rear gusset panels terminate in an upper seam. The bottom edges of the front panel, the rear panel, the front gusset panels and the rear gusset panels terminate in a lower seam. The lower seam is perpendicular to the linear side edges of the front and rear panels.

A U-shaped cut-out is provided. The cut-out is located in an upper portion of the bag and commences at a first point along the upper seam. The cut-out is spaced inwardly from the first linear side edge and extends to a second point along the upper seam where the cut-out is spaced inwardly from the second linear side edge. The cut-out extends downwardly toward the lower seam, forming an open mouth and a pair of bag handles.

In another variant of the invention, each bag is a star sealed bag. Each bag has a front panel and a rear panel. The front panel has first and second parallel linear side edges, a top edge and a bottom edge. The rear panel has first and second parallel linear side edges, a top edge and a bottom edge.

Each star sealed bag has two front gusset panels of a second predetermined dimension. Each front gusset panel has a top edge, a bottom edge, inner and outer parallel side edges. Each front gusset panel is joined at the outer side edge to one of the linear side edges of the front panel and extends from the top edge of the front panel to the bottom edge thereof. The inner parallel side edges of the front gusset panels abut one another. Each bag has two rear gusset panels of the second predetermined dimension. Each rear gusset panel has a top edge, a bottom edge, inner and outer parallel side edges. Each rear gusset panel is joined at the outer side edge to one of the linear side edges of the rear panel and extends from the top edge of the front panel to the bottom edge thereof. The inner parallel side edges of the rear gusset panels abut one another.

Each front gusset panel also is joined to a respective one of the rear gusset panels at the inner side edge. Each of the front and rear gusset panels is folded inwardly relative to the front and the rear panel. The front and rear panels are folded along a central axis such that the first and second parallel linear side edges abut one another. The top edges of the front panel, the rear panel, the front gusset panels and the rear gusset panels terminate at the perforated severance line. The bottom edges of the front panel, the rear panel, the front gusset panels and the rear gusset panels terminate in a lower seam. The lower seam is perpendicular to the linear side edges of the front and rear panels and seals together eight layers, which include the front and rear panels and the front and rear gusset panels. When the bag is opened, the lower seam will cause the bag to have a star sealed bottom.

In another variant of the invention, each bag is a handlestar bag. Each bag has a front panel and a rear panel. The front panel has first and second parallel linear side edges, a top edge and a bottom edge. The rear panel has first and second parallel linear side edges, a top edge and a bottom edge.

Each handlestar bag has two front gusset panels of a third predetermined dimension. Each front gusset panel has a top edge, a bottom edge, inner and outer parallel side edges. Each front gusset panel is joined at the outer side edge to one of the linear side edges of the front panel and extends from the top edge of the front panel to the bottom edge thereof. The inner parallel side edges of the front gusset panels are spaced from one another by a third predetermined distance. Each bag has two rear gusset panels of the first predetermined dimension. Each rear gusset panel has a top edge, a bottom edge, inner and outer parallel side edges. Each rear gusset panel is joined at the outer side edge to one of the linear side edges of the rear panel and extends from the top edge of the front panel to the bottom edge thereof. The inner parallel side edges of the rear gusset panels are spaced from one another by the first predetermined distance. Each front gusset panel also is joined to a respective one of the rear gusset panels at the inner side edge. Each of the front and rear gusset panels is folded inwardly relative to the front and the rear panel. The top edges of the front panel, the rear panel, the front gusset panels and the rear gusset panels terminate in an upper seam below the perforated severance line.

Each handlestar bag has a U-shaped cut-out. The U-shaped cut-out is located in an upper portion of the bag. The cut-out commences at a first point along the upper seam spaced inwardly from the first linear side edge and extends to a second point along the upper seam spaced inwardly from the second linear side edge. The cut-out extends downwardly toward a lower seam, thereby forming an open mouth and a pair of bag handles.

The front and rear panels are folded along a central axis such that the first and second parallel linear side edges abut one another. The bottom edges of the front panel, the rear panel, the front gusset panels and the rear gusset panels terminate in a lower seam. The lower seam is perpendicular to the linear side edges of the front and rear panels and seals together eight layers, which include the front and rear panels and the front and rear gusset panels. When the bag is opened the lower seam will cause the bag to have a star sealed bottom.

In another variant, each bag has a chisel cut. The cut penetrates the perforated severance line and is located thereon so as to align with the perforation parting means of the dispenser.

In yet another variant, the perforated severance line is formed of a series of alternating cuts and perforations, with at least one of the cuts located so as to align with the perforation parting means.

In another variant of the invention, the bag roll restraining means has a horizontal bar. The bar has a first end and a second end and is located parallel to the horizontal axis of the bag roll. The bar is attached at least one end to the means for constraining movement of the compact bag roll along the horizontal axis.

In another embodiment, the bag roll restraining means has at least one upright post. The post has an upper end and a lower end. The post is spaced from the horizontal axis of the compact bag roll and located to bear at its upper end against the outside bag of the roll as the roll is urged toward the post by the lower bag roll support. The post is attached at its lower end to the lower bag roll support.

In another variant, the bag roll restraining means has a first angled plate. The plate has an upper end and a lower end and is sized, shaped and located to bear against the outside bag of the roll as the roll is urged toward the angled plate by the lower bag roll support. The plate is attached at its lower end to the lower bag roll support.

In yet another variant, the bag roll restraining means has at least one first wire loop. The first wire loop has a lower end and a curved upper end. The loop is spaced from the horizontal axis of the compact bag roll and is sized, shaped and located to bear against the outside bag of the roll as the roll is urged toward the loop by the lower bag roll support. The loop is attached at its lower end to the lower bag roll support.

In another embodiment of the invention the lower bag roll support has at least two angled bars. The bars have a first end and a second end and are located below the horizontal axis of the compact bag roll and are aligned so as to urge the compact bag roll toward the restraining means.

In yet another embodiment, the lower bag roll support has a second angled plate. The plate has a first end, a second end, and first and second sides. The plate is located below the horizontal axis of the compact bag roll and is aligned so as to urge the compact bag roll toward the restraining means.

In another variant of the invention, the lower bag roll support has a first curved plate. The plate has a first end, a second end, and first and second sides. The plate is located below the horizontal axis of the compact bag roll and is aligned so as to urge the compact bag roll toward the restraining means.

In yet another variant, the means for constraining movement of the compact bag roll along the horizontal axis has at least one vertical side wall. The side wall is located orthogonally to the horizontal axis of the compact bag roll and attached at a lower edge to the lower bag roll support.

In another embodiment the means for constraining movement of the compact bag roll along the horizontal axis has at least one upright constraint rod. The rod extends upwardly from the lower bag roll support, adjacent to a side of the compact bag roll.

In yet another embodiment, the perforation parting means has at least one second wire loop, extending upwardly from the lower bag roll support. The loop is located at the horizontal axis of the compact bag roll so that an upper end of the second wire loop will engage the perforated severance line.

In another variant of the invention, the perforation parting means has a frictional end piece which is mounted at an upper end of the parting means. The end piece is formed of material that adheres to plastic bag material to facilitate separation and opening of the first bag from the subsequent bag.

In another variant, the means for directing the bags from the bag roll over the perforation parting means has a first formed panel which has a first end and a second end. The panel is attached at the second end to the lower bag roll support. The first formed panel has a guide slot formed at the first end which is sized, shaped and located to constrain a folded bag and to direct the bag over the perforation parting means.

In yet another variant, the means for directing the bags from the bag roll over the perforation parting means has first and second directing members. The directing members have first and second ends and are mounted at the second ends to the lower bag roll support. The ends are spaced outwardly from the horizontal axis of the compact bag roll.

In another embodiment of the invention, the bags have an adhering means. The folding means is affixed to an outer surface of the folded bag such that the outer surface will be removably affixed to an outer surface of a subsequent bag on the compact roll. The adhering means causes the perforated severance line of the outer surface to part as bags are pulled from the compact roll.

In another embodiment, the adhering means is selected from the group that includes the application of heat and pressure, cold pressure, corona discharge treatment, and application of plastic solvents.

In yet another embodiment, the dispenser has a means for securing the dispenser to a surface.

In another variant of the invention, the combination of rolled bags and dispenser has a plurality of plastic bags, where each of the bags has first and second parallel linear side edges, a top edge and a bottom edge. The bags are joined along a perforated severance line between the bottom edge of a first bag and the top edge of a subsequent bag. The bags are rolled about a horizontal axis to form a compact bag roll from which the bags are dispensed and the compact bag roll has a first predetermined width.

A dispenser is provided, which includes a bag roll restraining means. The restraining means extends across at least a portion of the first predetermined width. A lower bag roll support is provided, which is located below the horizontal axis. A means for constraining movement of the compact bag roll along the horizontal axis is provided. A bag opening means is provided, which has a mounting member and a bag opening element.

The mounting member has an upper and a lower end and is sized, shaped and located to position the bag opening element on or outward from the restraining means at a level sufficient to engage an outer surface of the outside bag of the compact roll as bags are withdrawn from the roll.

The bag opening element is located at the upper end of the mounting member and is formed of material which has a high coefficient of friction with respect to plastic bag material.

The compact bag roll is located within the dispenser with an outside bag of the roll extendable over the bag roll restraining means and the bag opening means. When the outside bag is pulled from the compact bag roll across the bag opening means, the bag opening element will retard the movement of an outermost layer of the outside bag, causing the bag to begin to open.

In another variant, each of the bags are folded along at least one axis parallel to the first and second parallel linear side edges.

In yet another variant, the lower bag roll support is shaped so as to urge the compact bag roll toward the restraining means.

In another embodiment of the invention, a perforation parting means is provided. The parting means is sized, shaped and located to engage the perforated severance line of bags pulled from the compact bag roll. When the compact bag roll is located within the dispenser with the first bag accessible for withdrawal from the dispenser, the bags may be serially withdrawn from the roll with each subsequent bag parted at the perforated severance line by the perforation parting means.

In another embodiment, the bag opening means is located between the restraining means and the perforation parting means.

In yet another embodiment, the material of the bag opening element is selected from the group that includes silicone, rubber, plastic and metal.

In another variant of the invention, the lower end of the mounting member is attached to the lower bag roll support.

In another embodiment, the mounting member is disposed horizontally across the first predetermined width of the bag roll. The bag opening element is disposed at a central portion of the mounting member and extends upwardly therefrom.

In another variant, a means for directing the bags from the bag roll over the perforation parting means is provided.

In yet another variant, the perforation parting means extends outwardly beyond the restraining means.

In another embodiment of the invention, each bag is a T-shirt style bag. Each bag has a front panel and a rear panel. The front panel has first and second parallel linear side edges, a top edge and a bottom edge. The rear panel has first and second parallel linear side edges, a top edge and a bottom edge. The bag contains two front gusset panels of a first predetermined dimension and two rear gusset panels of the first predetermined dimension. Each front gusset panel has a top edge, a bottom edge, first and second parallel side edges and is joined at the first side edge to one of the linear side edges of the front panel and extending from the top edge of the front panel to the bottom edge thereof. Each rear gusset panel has a top edge, a bottom edge, first and second parallel side edges and is joined at the first side edge to one of the linear side edges of the rear panel and extending from the top edge of the front panel to the bottom edge thereof.

Each front gusset panel also is joined to a respective one of the rear gusset panels at the second side edge. Each of the front and rear gusset panels is folded inwardly relative to the front and the rear panel. The top edges of the front panel, the rear panel, the front gusset panels and the rear gusset panels terminate in an upper seam. The bottom edges of the front panel, the rear panel, the front gusset panels and the rear gusset panels terminate in a lower seam. The lower seam is perpendicular to the linear side edges of the front and rear panels.

A U-shaped cut-out is provided, which is located in an upper portion of the bag and commences at a first point along the upper seam spaced inwardly from the first linear side edge. The cut-out extends to a second point along the upper seam spaced inwardly from the second linear side edge and extends downwardly toward the lower seam, thereby forming an open mouth and a pair of bag handles.

In another embodiment, each bag is a star sealed bag. Each bag has a front panel and a rear panel. The front panel has first and second parallel linear side edges, a top edge and a bottom edge. The rear panel has first and second parallel linear side edges, a top edge and a bottom edge.

Each star sealed bag has two front gusset panels of a second predetermined dimension. Each front gusset panel has a top edge, a bottom edge, inner and outer parallel side edges. Each front gusset panel is joined at the outer side edge to one of the linear side edges of the front panel and extends from the top edge of the front panel to the bottom edge thereof. The inner parallel side edges of the front gusset panels abut one another. Each bag has two rear gusset panels of the second predetermined dimension. Each rear gusset panel has a top edge, a bottom edge, inner and outer parallel side edges. Each rear gusset panel is joined at the outer side edge to one of the linear side edges of the rear panel and extends from the top edge of the front panel to the bottom edge thereof. The inner parallel side edges of the rear gusset panels abut one another.

Each front gusset panel also is joined to a respective one of the rear gusset panels at the inner side edge. Each of the front and rear gusset panels is folded inwardly relative to the front and the rear panel. The front and rear panels are folded along a central axis such that the first and second parallel linear side edges abut one another.

The top edges of the front panel, the rear panel, the front gusset panels and the rear gusset panels terminate at the perforated severance line. The bottom edges of the front panel, the rear panel, the front gusset panels and the rear gusset panels terminate in a lower seam. The lower seam is perpendicular to the linear side edges of the front and rear panels and seals together eight layers, which include the front and rear panels and the front and rear gusset panels. When the bag is opened, the lower seam will cause the bag to have a star sealed bottom.

In yet another embodiment, each bag is a handlestar bag. Each bag has a front panel and a rear panel. The front panel has first and second parallel linear side edges, a top edge and a bottom edge. The rear panel has first and second parallel linear side edges, a top edge and a bottom edge.

Each handlestar bag has two front gusset panels of a third predetermined dimension. Each front gusset panel has a top edge, a bottom edge, inner and outer parallel side edges. Each front gusset panel is joined at the outer side edge to one of the linear side edges of the front panel and extends from the top edge of the front panel to the bottom edge thereof. The inner parallel side edges of the front gusset panels are spaced from one another by a third predetermined distance. Each bag has two rear gusset panels of the first predetermined dimension. Each rear gusset panel has a top edge, a bottom edge, inner and outer parallel side edges. Each rear gusset panel is joined at the outer side edge to one of the linear side edges of the rear panel and extends from the top edge of the front panel to the bottom edge thereof. The inner parallel side edges of the rear gusset panels are spaced from one another by the first predetermined distance.

Each front gusset panel also is joined to a respective one of the rear gusset panels at the inner side edge. Each of the front and rear gusset panels is folded inwardly relative to the front and the rear panel. The top edges of the front panel, the rear panel, the front gusset panels and the rear gusset panels terminate in an upper seam below the perforated severance line.

Each handlestar bag has a U-shaped cut-out. The U-shaped cut-out is located in an upper portion of the bag. The cut-out commences at a first point along the upper seam spaced inwardly from the first linear side edge and extends to a second point along the upper seam spaced inwardly from the second linear side edge. The cut-out extends downwardly toward the lower seam, thereby forming an open mouth and a pair of bag handles.

The front and rear panels are folded along a central axis such that the first and second parallel linear side edges abut one another. The bottom edges of the front panel, the rear panel, the front gusset panels and the rear gusset panels terminate in a lower seam. The lower seam is perpendicular to the linear side edges of the front and rear panels and seals together eight layers, which include the front and rear panels and the front and rear gusset panels. When the bag is opened the lower seam will cause the bag to have a star sealed bottom.

In another variant of the invention, each bag has a chisel cut. The chisel cut penetrates the perforated severance line and is located thereon so as to align with the perforation parting means of the dispenser.

In another variant, the perforated severance line is formed of a series of alternating cuts and perforations, with at least one of the cuts located so as to align with the perforation parting means.

In yet another variant, the bag roll restraining means has a horizontal bar. The horizontal bar has a first end and a second end and is located parallel to the horizontal axis of the bag roll. The horizontal bar is attached at least one end to the means for constraining movement of the compact bag roll along the horizontal axis.

In another embodiment of the invention, the bag roll restraining means has at least one upright post, which has an upper end and a lower end. The post is spaced from the horizontal axis of the compact bag roll and located to bear at its upper end against the outside bag of the roll as the roll is urged toward the post by the lower bag roll support. The post is attached at its lower end to the lower bag roll support.

In another embodiment, the bag roll restraining means has a first angled plate. The plate has an upper end and a lower end and is sized, shaped and located to bear against the outside bag of the roll as the roll is urged toward the angled plate by the lower bag roll support. The angled plate is attached at its lower end to the lower bag roll support.

In yet another embodiment, the bag roll restraining means has at least one first wire loop, which has a lower end and a curved upper end. The loop is spaced from the horizontal axis of the compact bag roll and is sized, shaped and located to bear against the outside bag of the roll as the roll is urged forward. The wire loop is attached at its lower end to the lower bag roll support.

In another variant of the invention, the lower bag roll support has at least two angled bars, which have a first end and a second end and are located below the horizontal axis of the compact bag roll. The bars are aligned so as to urge the compact bag roll toward the restraining means. The bars are attached at the first end to the means for constraining movement of the compact bag roll along the horizontal axis.

In another variant, the lower bag roll support has a second angled plate, which has a first end, a second end, first and second sides and is located below the horizontal axis of the compact bag roll. The plate is aligned so as to urge the compact bag roll toward the restraining means. The plate is attached at the first and second sides to the means for constraining movement of the compact bag roll along the horizontal axis and attached at the second end to the bag roll restraining means.

In yet another variant, the lower bag roll support has a first curved plate, which has a first end, a second end, first and second sides and is located below the horizontal axis of the compact bag roll. The plate is aligned so as to urge the compact bag roll toward the restraining means. The plate is attached at the first and second sides to the means for constraining movement of the compact bag roll along the horizontal axis and attached at the second end to the bag roll restraining means.

In another embodiment of the invention, the means for constraining movement of the compact bag roll along the horizontal axis has at least one vertical side wall, which is located orthogonally to the horizontal axis of the compact bag roll and attached at a lower edge to the lower bag roll support.

In another embodiment, the means for constraining movement of the compact bag roll along the horizontal axis has at least one upright constraint rod, which extends upwardly from the lower bag roll support, adjacent a side of the compact bag roll.

In yet another embodiment, the perforation parting means has at least one second wire loop. The loops extends upwardly from the lower bag roll support and is located at the horizontal axis of the compact bag roll so that an upper end of the second wire loop will engage the perforated severance line.

In another variant of the invention, the perforation parting means has a frictional end piece, which is mounted at an upper end of the perforation parting means. The end piece is formed of material that adheres to plastic bag material to facilitate separation and opening of the first bag from the subsequent bag.

In another variant, the means for directing the bags from the bag roll over the perforation parting means has a first formed panel, which has a first end, a second end and is attached at the second end to the lower bag roll support. The panel has a guide slot formed at the first end, which is sized, shaped and located to constrain a folded bag and to direct the bag over the perforation parting means.

In yet another variant, the means for directing the bags from the bag roll over the perforation parting means has first and second directing members, which have first and second ends and are mounted at the second ends to the lower bag roll support and are spaced outwardly from the horizontal axis of the compact bag roll.

Further variants of the invention include a tray-like dispenser, a dispenser with glue tabs for mounting to a surface, a dispenser with weighted mounting feet, and a dispenser designed to be mounted under a counter.

In another embodiment of the invention, a dispenser support attachment means is provided. The attachment means is affixed to the dispenser. A dispenser support is also provided. The dispenser support has a means for attaching to a surface, an extension means and means for removably attaching to the dispenser support attachment means.

In another embodiment, the dispenser support attachment means has at least one receiving bracket that is sized, shaped and disposed to accept the attachment means for removably attaching to the dispenser attachment means.

In yet another embodiment, the means for removably attaching to the dispenser attachment means has at least one engagement tab which is attached to the extension means and is sized, shaped, and disposed to fit frictionally into the receiving bracket.

In another variant of the invention, the means for attaching to a surface is a wall mounting.

In another variant, the means for attaching to a surface is either of a floor mounting or a counter mounting.

In yet another variant, a dispenser support attachment means is provided. The attachment means is affixed to the dispenser. A dispenser support is also provided. The dispenser support has a means for attaching to a surface, an extension means and means for removably attaching to the dispenser attachment means.

In another varient of the invention, the dispenser support attachment means has at least one receiving bracket which is sized, shaped and located to accept the means for removably attaching to the dispenser attachment means.

In another varient, the means for removably attaching to said dispenser attachment means has at least one engagement tab which is attached to the extension means and is sized, shaped, and located to fit frictionally into the receiving bracket.

In yet another varient, the means for attaching to a surface is a wall mounting.

In still another variant, the means for attaching to a surface is either of a floor mounting or a counter mounting.

(1) In a further variant of the invention, a dispensing system includes a wire frame, a lower bag roll support, a constraining movement element, a bag roll restraining element and a perforation parting means. The frame includes four corners each of approximately 90 degrees, has a C shape in a horizontal plane, and includes a dispensing end, a back end, and two sides. The lower bag roll support includes a proximal end and a distal end. The distal end is attached to the back end of the frame, and the lower bag roll support extends angularly downward from the distal end toward the proximal end. The constraining movement element is attached to the two sides of the wire frame, and has two, approximately 90 degree angles that form side panels. Adjacent to the proximal end of the lower bag roll support the bag roll restraining element is attached to both of the sides of the frame and the perforation parting means is located adjacent the proximal end.

A plurality of plastic bags is provided. Each of the bags has first and second parallel linear side edges, a top edge and a bottom edge. The bags are joined along a perforated severance line between the bottom edge of a first bag and the top edge of a subsequent bag. The bags are rolled about a horizontal axis to form a bag roll from which the bags are dispensed. The bag roll has a first predetermined width narrower than a distance between the side panels. When the bag roll is located within the dispenser with the first bag is accessible for withdrawal from the dispenser, the bags may be serially withdrawn from the roll with each subsequent bag being parted at the perforated severance line.

(2) In still a further variant, means are provided for directing the bags from the bag roll over the perforation parting means.

(3) In yet a further variant, the perforation parting means extends outwardly beyond the bag roll restraining means.

(4) In another variant of the invention, each bag further includes a chisel cut, the chisel cut penetrating the perforated severance line and is located thereon so as to align with the perforation parting means of the dispenser.

(5) In still another variant, the perforated severance line is formed of a series of alternating cuts and perforations, at least one of the cuts is located so as to align with the perforation parting means.

(6) In yet another variant, each of the bags is folded along at least one axis parallel to the first and second parallel linear side edges.

(7) In a further variant, elements that make up the frame are substantially circular in cross-section.

(8) In still a further variant, elements that make up the frame are substantially rectangular in cross-section.

(9) In yet a further variant, elements that make up the frame are substantially triangular in cross-section.

(10) In another variant of the invention, a dispensing system includes a wire frame, a lower bag roll support, a constraining movement element, a bag roll restraining means and a perforation parting means. The frame includes four corners each of approximately 90 degrees, has a C shape in a horizontal plane, and includes a dispensing end, a back end, and two sides. The lower bag roll support includes a proximal end and a distal end. The distal end includes a plurality of angled corners. The distal end is attached to the back end of the frame, and the lower bag roll support extends angularly downward from the distal end toward the proximal end. The constraining movement element is attached to the two sides of the wire frame, and has two, approximately 90 degree angles that form side panels. Adjacent to the proximal end of the lower bag roll support, the bag roll restraining means is attached to the frame. The perforation parting means is located adjacent the proximal end. A plurality of plastic bags is provided. Each of the bags has first and second parallel linear side edges, a top edge and a bottom edge. The bags are joined along a perforated severance line between the bottom edge of a first bag and the top edge of a subsequent bag. The bags are rolled about a horizontal axis to form a bag roll from which the bags are dispensed. The bag roll has a first predetermined width narrower than a distance between the side panels. When the bag roll is located within the dispenser with the first bag being accessible for withdrawal from the dispenser, the bags may be serially withdrawn from the roll with each subsequent bag is parted at the perforated severance line.

(11) In still another variant, means for directing the bags from the bag roll over the perforation parting means are provided.

(12) In yet another variant, the perforation parting means extends outwardly beyond the bag roll restraining means.

(13) In a further variant, each bag further includes a chisel cut, the chisel cut penetrates the perforated severance line and is located thereon so as to align with the perforation parting means of the dispenser.

(14) In still a further variant, the perforated severance line is formed of a series of alternating cuts and perforations, at least one of the cuts is located so as to align with the perforation parting means.

(15) In yet a further variant, each of the bags is folded along at least one axis parallel to the first and second parallel linear side edges.

(16) In another variant of the invention, elements that make up the frame are substantially circular in cross-section.

(17) In still another variant, elements making up the frame are substantially rectangular in cross-section.

(18) In a final variant, elements making up the frame are substantially triangular in cross-section.

An appreciation of the other aims and objectives of the present invention and an understanding of it may be achieved by referring to the accompanying drawings and the detailed description of a preferred embodiment.

DESCRIPTION OF THE DRAWINGS

FIG. 10 is a perspective view of a dispenser wherein the restraining means is an upright post;

FIG. 11 is a perspective view of a dispenser wherein the restraining means is a first angled plate;

FIG. 12 is a perspective view of a dispenser wherein the restraining means is a wire loop;

FIG. 22 is a perspective view of another embodiment of a bag roll dispenser;

FIG. 23 is a perspective view of a combination dispenser and rolled plastic bags wherein each of the bags are folded along one axis parallel to the first and second parallel linear side edges;

FIG. 25 is an exploded view of a dispenser wherein the bag opening means is disposed between the restraining means and the perforation parting means;

DETAILED DESCRIPTION OF THE PREFERRED EMBODIMENT

Figure 8A:
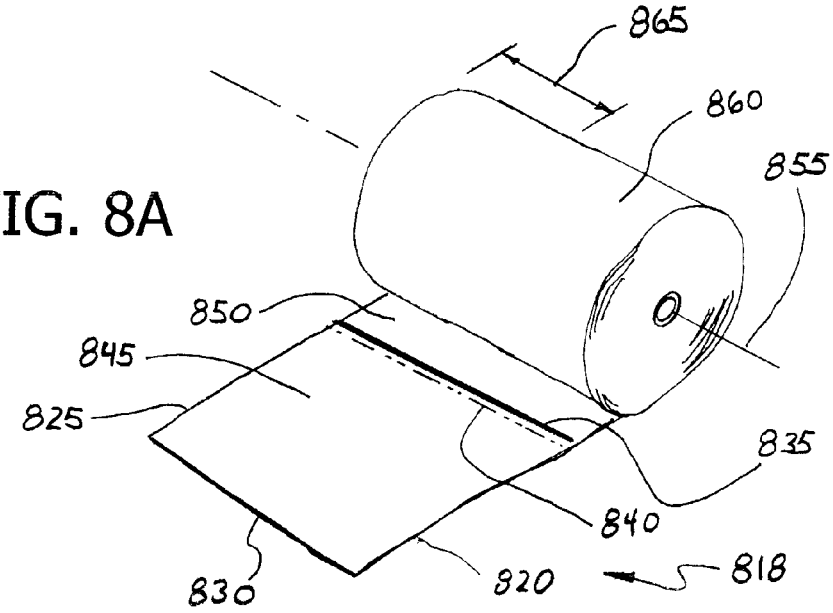
FIG. 8A is a perspective view of a compact bag roll wherein the bags are non-folded T-shirt style bags.
Figure 7:
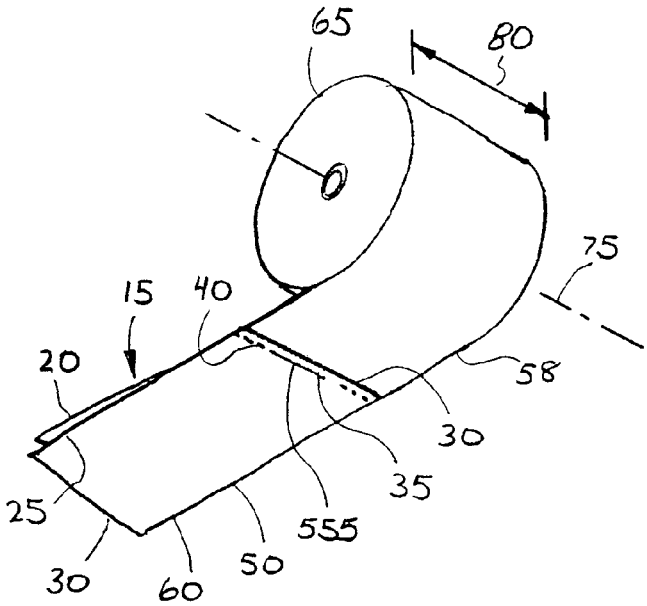
FIG. 7 is a perspective view of a compact bag roll wherein each bag has a chisel cut.
Figure 8:
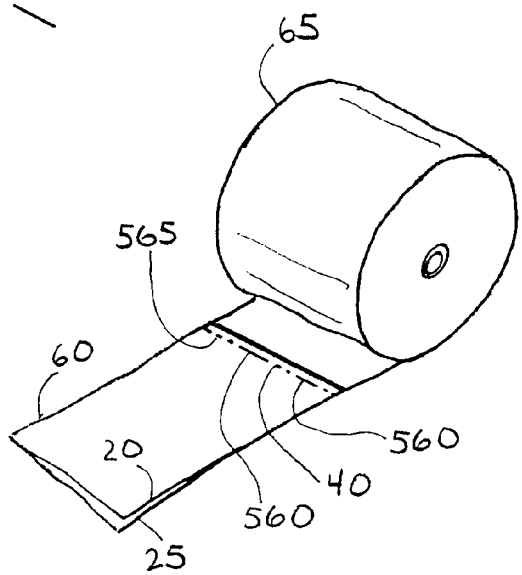
FIG. 8 is a perspective view of a compact bag roll wherein the perforated severance line is formed of a series of alternating cuts and perforations.

FIGS. 1-37 illustrate a combination plastic bag roll and dispenser 10 providing the desired features that may be constructed from the following components. As shown in FIGS. 4-8 and 37, a plurality of plastic bags 15 is provided. As illustrated in FIGS. 7, 8 and 37, each of the bags 15 has first 20 and second 25 parallel linear side edges, a top edge 30 and a bottom edge 35. The bags 15 are joined along a perforated severance line 40 between the bottom edge 35 of a first bag 50 and the top edge 30 of a subsequent bag 58. The bags 15 are folded along at least one axis 60 parallel to the first 20 and second 25 parallel linear side edges. The bags 15 are rolled about a horizontal axis 75 to form a compact bag roll 65 from which the bags 15 are dispensed. The compact bag roll 65 has a first predetermined width 80.

Figure 1:
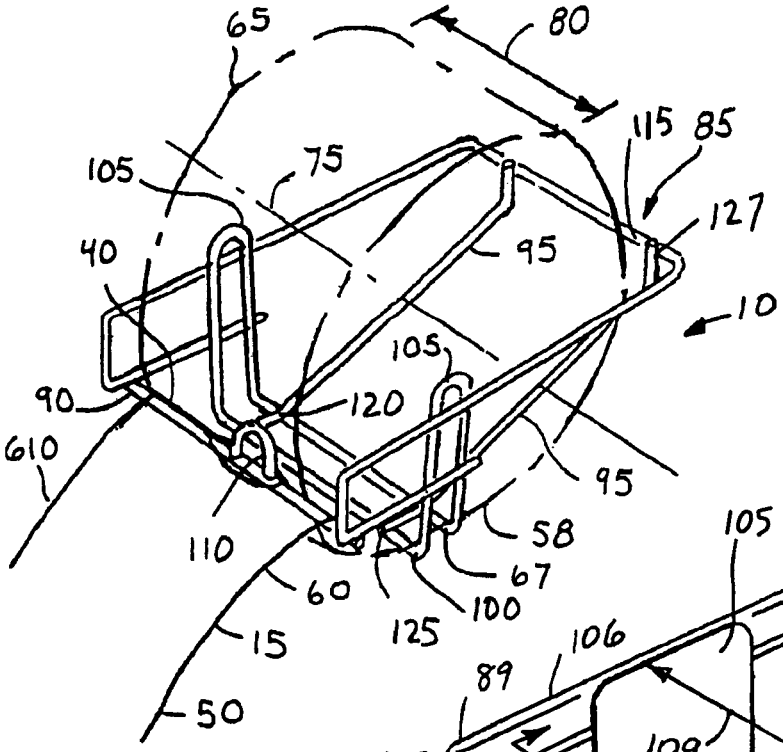
FIG. 1 is a perspective view of a first embodiment of a combination of rolled plastic bags and dispenser.
Figure 2A:
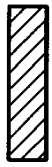
FIG. 2A is a cross-sectional view of a portion of the wire frame taken along the line 2A,2B illustrating a rectangular cross-section.
Figure 2:
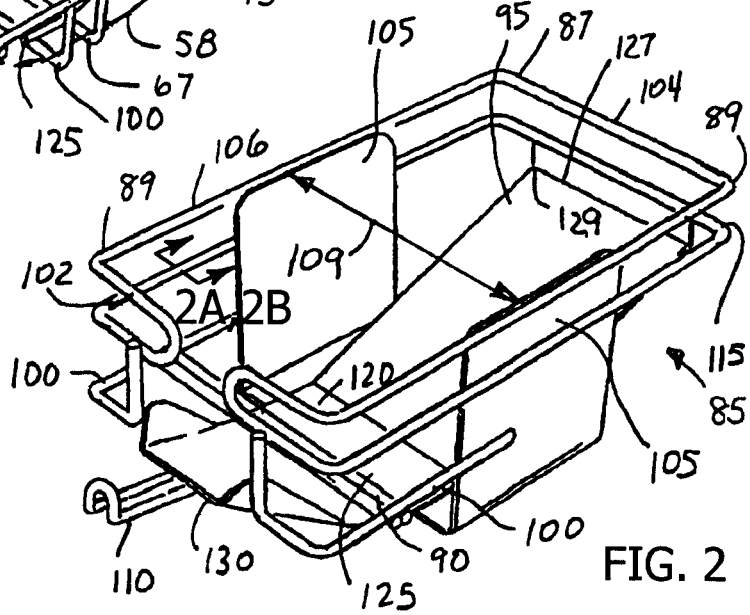
FIG. 2 is a perspective view of a second embodiment of the combination of rolled plastic bags including means for directing the bags from said bag roll over the perforation parting means.
Figure 2B:
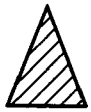
FIG. 2B is a cross-sectional view of a portion of the wire frame taken along the line 2A,2B illustrating a triangular cross-section.
Figure 3:
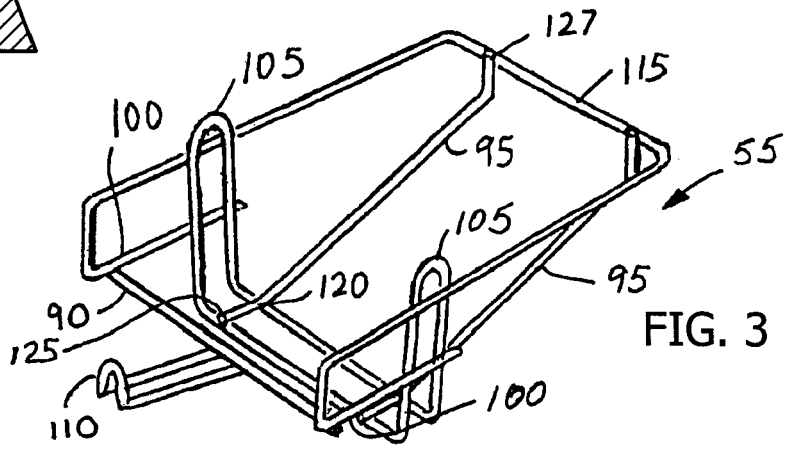
FIG. 3 is a perspective view of the second embodiment of the combination or rolled plastic bags and dispenser with the perforation parting means extending outwardly beyond said restraining means.

As shown in FIGS. 1, 2 and 3, a dispenser 85 is provided. The dispenser 85 includes a wire frame 87 and a bag roll restraining means 90. The bag roll restraining element 90 extends across at least a portion of the first predetermined width 80. The bags 15 exit the dispenser 85 above the bag roll restraining means 90. A lower bag roll support 95 is provided.

A restraining means support 100 is provided. The restraining means support 100 locates the bag roll restraining means 90 above a lowest portion 120 of the lower bag roll support 95. The lower bag roll support 95 has a proximal end 125 and a distal end 127 is located below the horizontal axis 75 at the distal end 127 and is shaped so as to urge the compact bag roll 65 toward the restraining means 90. A positioning element 115 is provided. The positioning element 115 locates the proximal end 125 of the lower bag roll support 95 above the horizontal axis 75. A constraining movement element 105 is provided for constraining movement of the compact bag roll along the horizontal axis 75. A perforation parting means is provided 110. The parting means 110 is sized, shaped and located to engage the perforated severance line 40 of the bags 15 pulled from the compact bag roll 65. The compact bag roll 65 has a lowest point 67.

The compact bag roll 65 is located within the dispenser 85 with the first bag 50 of the roll 65 extendable over the perforation parting means 110. The compact bag roll 65 is located within the dispenser 85 with the first bag 50 accessible for withdrawal from the dispenser 85. Subsequent bags 58 may be serially withdrawn from the roll 65 with each subsequent bag 58 parted at the perforated severance line 40.

In a variant of the invention, illustrated in FIG. 2, a means for directing 130 the bags 15 from the bag roll 65 over the perforation parting means 110 is provided.

In another variant, illustrated in FIG. 3 the perforation parting 110 means extends outwardly beyond the restraining means 90.

Figure 4:
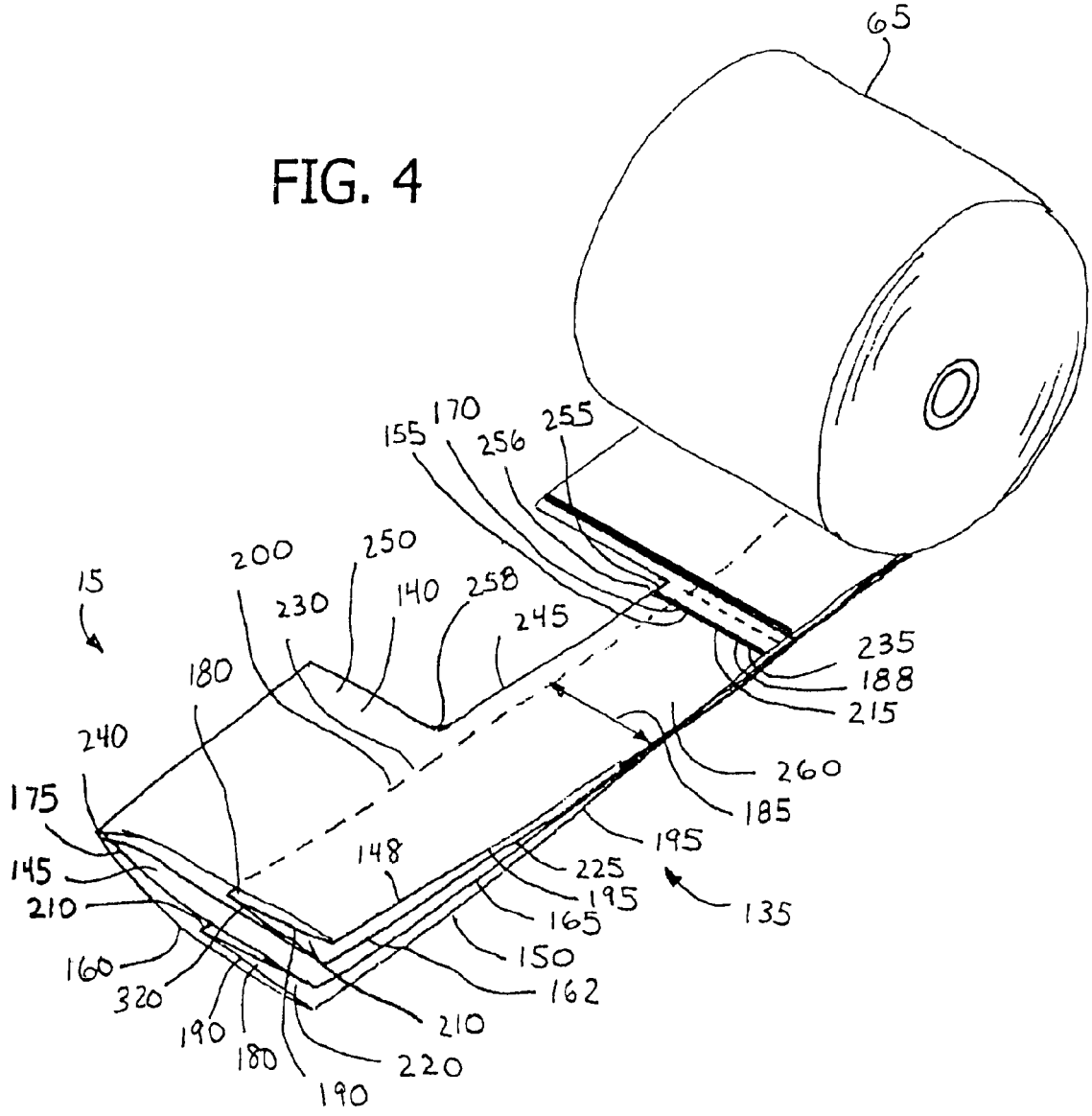
FIG. 4 is a perspective view of T-shirt style merchandise bags rolled into a compact roll with a first bag of the roll.

In yet another variant, illustrated in FIG. 4, each bag 15 is a T-shirt style bag 135. Each bag 135 has a front panel 140 and a rear panel 145. Each front panel 140 has first 148 and second 150 parallel linear side edges, a top edge 155 and a bottom edge 160. Each rear panel 145 has first 162 and second 165 parallel linear side edges, a top edge 170 and a bottom edge 175.

Each T-shirt style bag 135 has two front gusset panels 180 of a first predetermined dimension 185. Each front gusset panel 180 has a top edge 188, a bottom edge 190, first 195 and second 200 parallel side edges. Each front gusset panel 180 is joined at the first side edge 195 to one of the linear side edges 148, 150 of the front panel 140 and extends from the top edge 188 of the front panel 140 to the bottom edge 190 thereof. Each bag 135 has two rear gusset panels 210 of the first predetermined dimension 185. Each rear gusset panel 210 has a top edge 215, a bottom edge 220, first 225 and second 230 parallel side edges. Each rear gusset panel 210 is joined at the first side edge 225 to one of the linear side edges 162, 165 of the rear panel 145 and extends from the top edge 170 of the rear panel 145 to the bottom edge 175 thereof.

Continuing on in FIG. 4, each front gusset panel 180 also is joined to a respective one of the rear gusset panels 210 at the second side edge 200, 230. Each of the front 180 and rear gusset panels 210 is folded inwardly relative to the front 140 and the rear 145 panels. The top edges 155, 170, 188, 215 of the front panel 140, the rear panel 145, the front gusset panels 180 and the rear gusset panels 210 terminate in an upper seam 2.35. The bottom edges 160, 175, 190, 220 of the front panel 140, the rear panel 145, the front gusset panels 180 and the rear gusset panels 210 terminate in a lower seam 240. The lower seam 240 is perpendicular to the linear side edges 148, 150, 162, 165 of the front 140 and rear panels 145.

A U-shaped cut-out 245 is provided, as illustrated in FIG. 4. The cut-out 245 is located in an upper portion 250 of the bag 135 and commences at a first point 255 along the upper seam 235. The cut-out 245 is spaced inwardly from the first linear side edge 148, 162 and extends to a second point 256 along the upper seam 235 where the cut-out 245 is spaced inwardly from the second linear side edge 150, 165. The cut-out 245 extends downwardly toward the lower seam 240, forming an open mouth 258 and a pair of bag handles 260.

Figure 5:
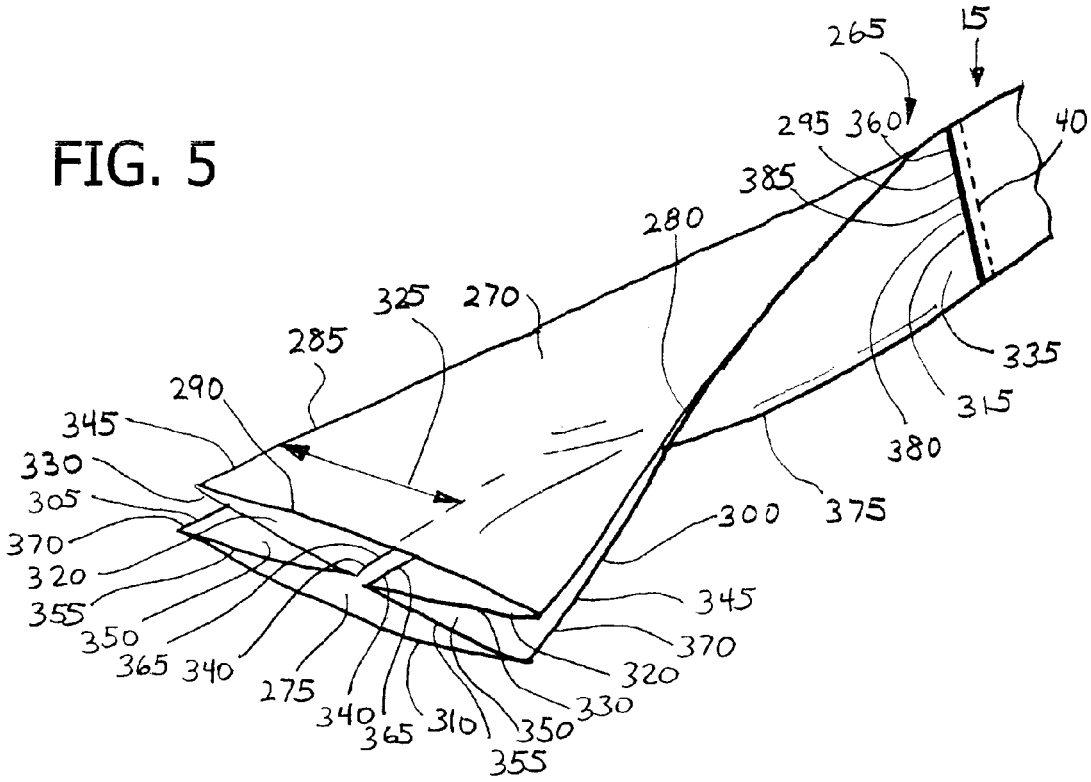
FIG. 5 is a perspective view of a star sealed bag.

In another variant of the invention, illustrated in FIG. 5, each bag 15 is a star sealed bag 265. Each bag 265 has a front panel 270 and a rear panel 275. The front panel 270 has first 280 and second 285 parallel linear side edges, a top edge 290 and a bottom edge 295. The rear panel 275 has first 300 and second 305 parallel linear side edges, a top edge 310 and a bottom edge 315.

Each star sealed bag 265 has two front gusset panels 320 of a second predetermined dimension 325. Each front gusset panel 320 has a top edge 330, a bottom edge 335, inner 340 and outer 345 parallel side edges. Each front gusset panel 320 is joined at the outer side edge 345 to one of the linear side edges 280, 285 of the front panel 270 and extends from the top edge 290 of the front panel 270 to the bottom edge 295 thereof. The inner parallel side edges 340 of the front gusset panels 320 abut one another. Each bag 265 has two rear gusset panels 350 of the second predetermined dimension 325. Each rear gusset panel 350 has a top edge 355, a bottom edge 360, inner 365 and outer 370 parallel side edges. Each rear gusset panel 350 is joined at the outer side edge 370 to one of the linear side edges 300, 305 of the rear panel 275 and extends from the top edge 290 of the front panel 270 to the bottom edge 335 thereof. The inner parallel side edges 365 of the rear gusset panels 350 abut one another.

Continuing on in FIG. 5, each front gusset panel 320 also is joined to a respective one of the rear gusset panels 350 at the inner side edge 340, 365. Each of the front 320 and rear gusset panels 350 is folded inwardly relative to the front 270 and the rear panel 275. The front 270 and rear panels 275 are folded along a central axis 375 such that the first 280, 300 and second 285, 305 parallel linear side edges abut one another. The top edges 290, 310, 330, 355 of the front panel 270, the rear panel 275, the front gusset panels 320 and the rear gusset panels 350 terminate at the perforated severance line 40. The bottom edges 295, 315, 335, 360 of the front panel 270, the rear panel 275, the front gusset panels 320 and the rear gusset panels 350 terminate in a lower seam 380. The lower seam 380 is perpendicular to the linear side edges 280, 285, 300, 305 of the front 270 and rear 275 panels and seals together eight layers, which include the front 270 and rear 275 panels and the front 320 and rear 350 gusset panels. When the bag 265 is opened, the lower seam 380 will cause the bag 265 to have a star sealed bottom 385.

Figure 6:
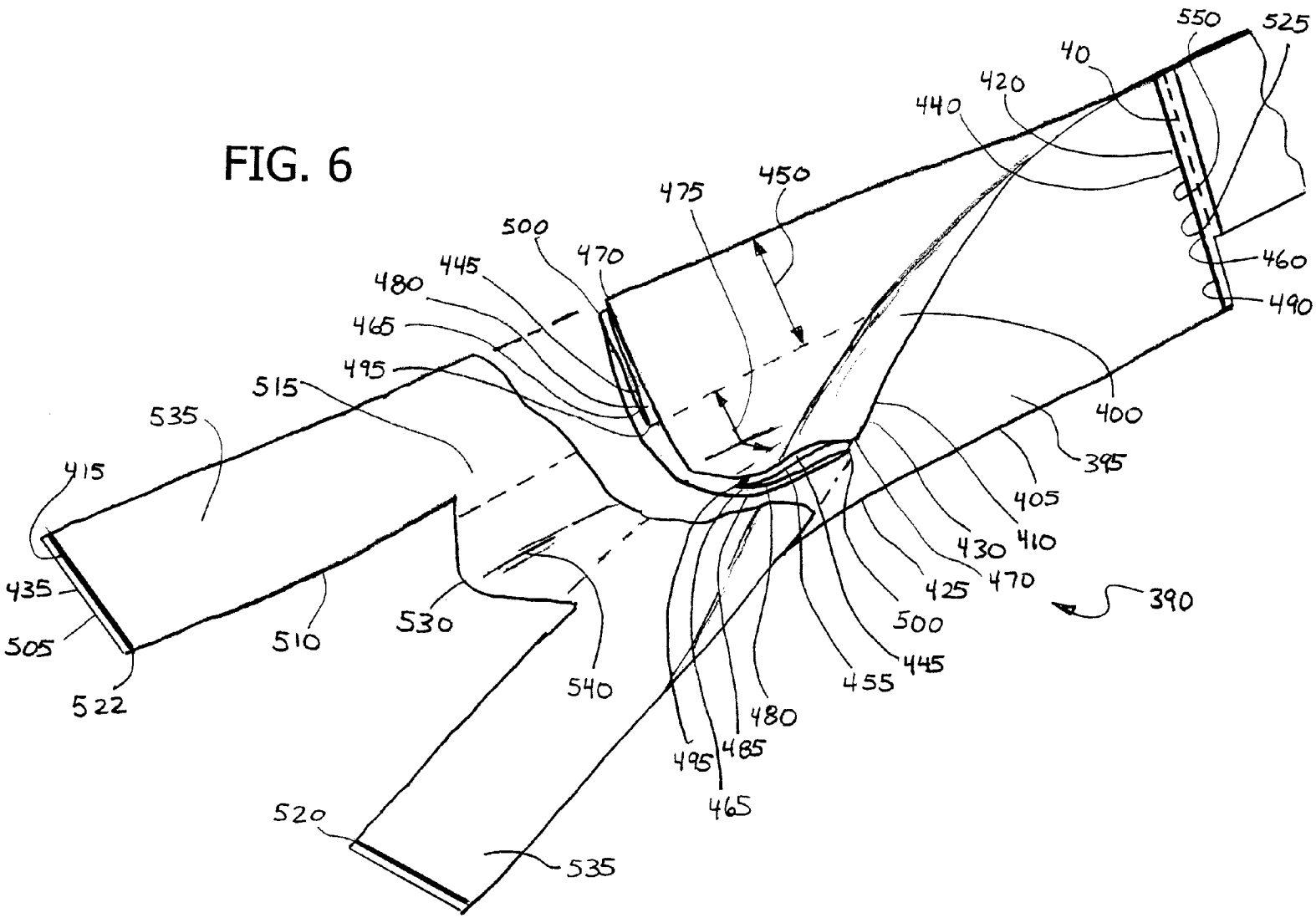
FIG. 6 is a perspective view of a star sealed bag having T-shirt style handles.

In another variant of the invention, illustrated as one bag in FIG. 6, each bag 15 is a star sealed bag with T-shirt style handles 390. Each bag 390 has a front panel 395 and a rear panel 400. The front panel 395 has first 405 and second 410 parallel linear side edges, a top edge 415 and a bottom edge 420. The rear panel 400 has first 425 and second 430 parallel linear side edges, a top edge 435 and a bottom edge 440.

Each bag 390 has two front gusset panels 445 of a third predetermined dimension 450. Each front gusset panel 445 has a top edge 455, a bottom edge 460, inner 465 and outer 470 parallel side edges. Each front gusset panel 445 is joined at the outer side edge 470 to one of the linear side edges 405, 410 of the front panel 395 and extends from the top edge 415 of the front panel 395 to the bottom edge 420 thereof. The inner parallel side edges 465 of the front gusset panels 445 are spaced from one another by a first predetermined distance 475. Each bag 390 has two rear gusset panels 480 of the third predetermined dimension 450. Each rear gusset panel 480 has a top edge 485, a bottom edge 490, inner 495 and outer 500 parallel side edges. Each rear gusset panel 480 is joined at the outer side edge 500 to one of the linear side edges 425, 430 of the rear panel 400 and extends from the top edge 415 of the front panel 395 to the bottom edge 420 thereof. The inner parallel side edges 495 of the rear gusset panels 480 are spaced from one another by the first predetermined distance 475. Each front gusset panel 445 also is joined to a respective one of the rear gusset panels 480 at the inner side edge 465, 495. Each of the front 445 and rear 480 gusset panels is folded inwardly relative to the front 395 and the rear 400 panel. The top edges 415, 435, 455, 485 of the front panel 395, the rear panel 400, the front gusset panels 445 and the rear gusset panels 480 terminate in an upper seam 505 below the perforated severance line 40.

Continuing on in FIG. 6, each bag 390 has a U-shaped cut-out 510. The U-shaped cut-out 510 is located in an upper portion 515 of the bag 390. The cut-out 510 commences at a first point 520 along the upper seam 505 spaced inwardly from the first linear side edge 405, 425 and extends to a second point 522 along the upper seam 505 spaced inwardly from the second linear side edge 410, 430. The cut-out 510 extends downwardly toward a lower seam 525, thereby forming an open mouth 530 and a pair of bag handles 535. The front 395 and rear 400 panels are folded along a central axis 540 such that the first 405, 425 and second 410, 430 parallel linear side edges abut one another. The bottom edges 420, 440, 460, 490 of the front panel 395, the rear panel 400, the front gusset panels 445 and the rear gusset panels 480 terminate in the lower seam 525. The lower seam 525 is perpendicular to the linear side edges 405, 410, 425, 430 of the front 395 and rear 400 panels and seals together eight layers, which include the front 395 and rear 400 panels and the front 445 and rear 480 gusset panels. When the bag 390 is opened the lower seam 525 will cause the bag 390 to have a star sealed bottom 550.

In another variant, illustrated in FIG. 7, each bag 15 has a chisel cut 555. The cut 555 penetrates the perforated severance line 40 and is located thereon so as to align with the perforation parting means 110 of the dispenser 85.

In yet another variant, illustrated in FIG. 8, the perforated severance line 40 is formed of a series of alternating cuts 560 and perforations 565, with at least one of the cuts 560 located so as to align with the perforation parting means 110.

Figure 9:
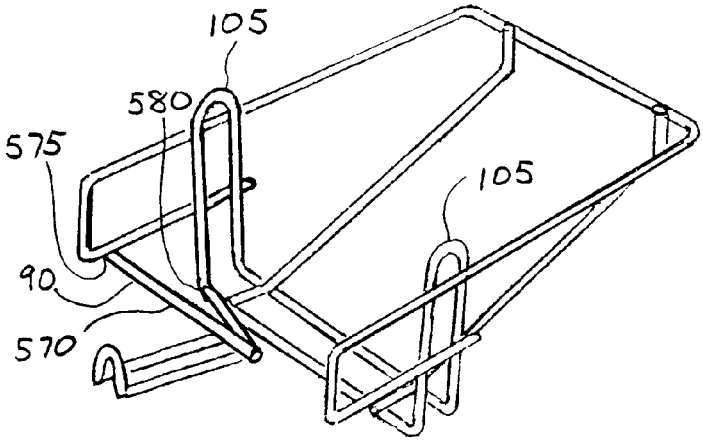
FIG. 9 is a perspective view of a dispenser wherein the restraining means is a horizontal bar.

In another variant of the invention, illustrated in FIG. 9, the bag roll restraining means 90 has a horizontal bar 570. The bar 570 has a first end 575 and a second end 580 and is located parallel to the horizontal axis 75 of the bag roll 65. The bar 570 is attached at least one end 575, 580 to the means for constraining movement 105 of the compact bag roll 65 along the horizontal axis 75.

In another embodiment, illustrated in FIGS. 1 and 10, the bag roll restraining means 90 has at least one upright post 585. The post 585 has an upper end 590 and a lower end 595. The post 585 is spaced from the horizontal axis 75 of the compact bag roll 65 and located to bear at its upper end 590 against an outside bag 610 of the roll 65 as the roll is urged toward the post 585 by the lower bag roll support 95. The post 585 is attached at its lower end 595 to the lower bag roll support 95.

In another variant, illustrated in FIGS. 1 and 11, the bag roll restraining means 90 has a first angled plate 615. The plate 615 has an upper end 620 and a lower end 625 and is sized, shaped and located to bear against the outside bag 610 of the roll 65 as the roll 65 is urged toward the angled plate 615 by the lower bag roll support 95. The plate 615 is attached at its lower end 625 to the lower bag roll support 95.

In yet another variant, illustrated in FIGS. 1 and 12, the bag roll restraining means 90 has at least one first wire loop 630. The first wire loop 630 has a lower end 635 and a curved upper end 640. The loop 630 is spaced from the horizontal axis 75 of the compact bag roll 65 and is sized, shaped and located to bear against the outside bag 610 of the roll 65 as the roll 65 is urged toward the loop 630 by the lower bag roll support 95. The loop 630 is attached at its lower end 635 to the lower bag roll support 95.

Figure 13:
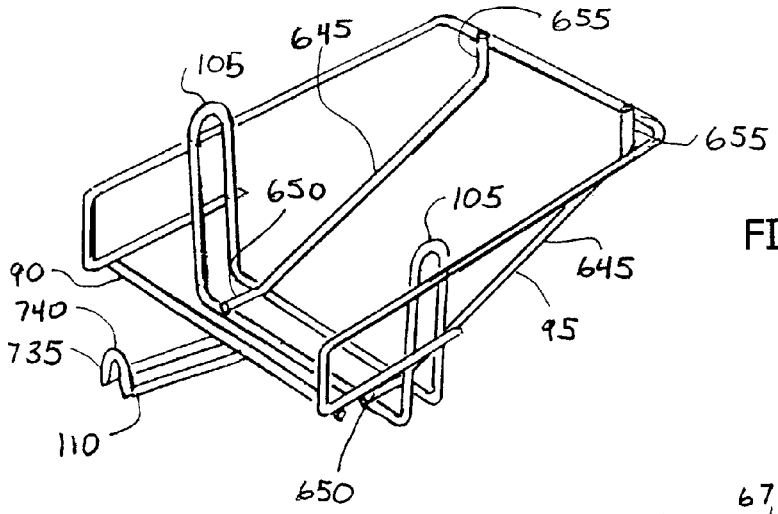
FIG. 13 is a perspective view of a dispenser wherein the lower bag roll support is two angled bars.

In another embodiment of the invention, illustrated in FIG. 13, the lower bag roll support 95 has at least two angled bars 645. The bars 645 have a first end 650 and a second end 655 and are located below the horizontal axis 75 of the compact bag roll 65 and are aligned so as to urge the compact bag roll 65 toward the bag roll restraining means 90.

Figure 14:
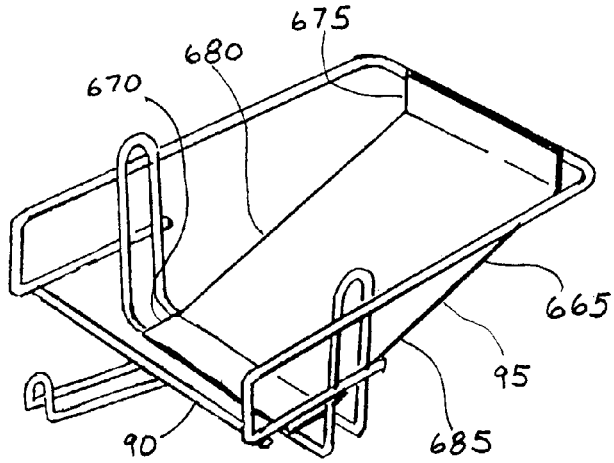
FIG. 14 is a perspective view of a dispenser wherein the lower bag roll support is an angled plate.

In yet another embodiment, illustrated in FIG. 14, the lower bag roll support 95 has a second angled plate 665. The plate 665 has a first end 670, a second end 675, and first 680 and second 685 sides. The plate 665 is located below the horizontal axis 75 of the compact bag roll 65 and is aligned so as to urge the compact bag roll 65 toward the restraining means 90.

Figure 15:
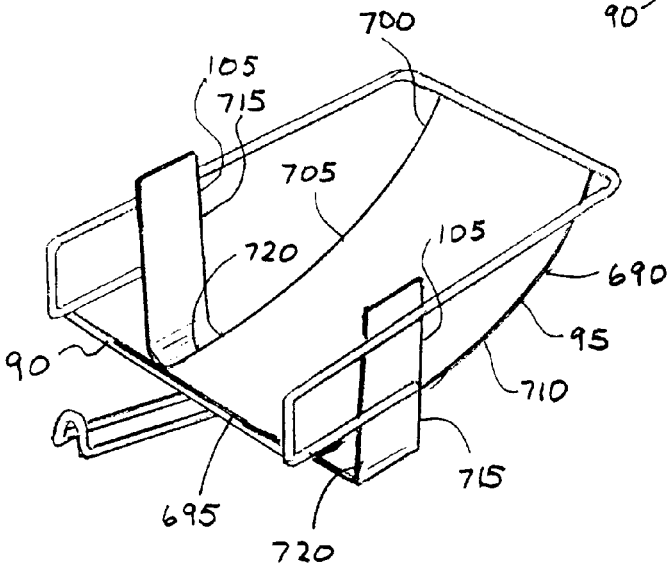
FIG. 15 is a perspective view of a dispenser two vertical side walls and wherein the lower bag roll support is a curved plate.

In another variant of the invention, illustrated in FIG. 15, the lower bag roll support 95 has a first curved plate 69.0. The plate has a first end 695, a second end 700, and first 705 and second 710 sides. The plate 690 is located below the horizontal axis 75 of the compact bag roll 65 and is aligned so as to urge the compact bag roll 65 toward the restraining means 90.

In yet another variant, also illustrated in FIG. 15, the means for constraining movement 105 of the compact bag roll 65 along the horizontal axis 75 has at least one vertical side wall 715. The side wall 715 is located orthogonally to the horizontal axis 75 of the compact bag roll 65 and attached at a lower edge 720 to the lower bag roll support 95.

Figure 16:
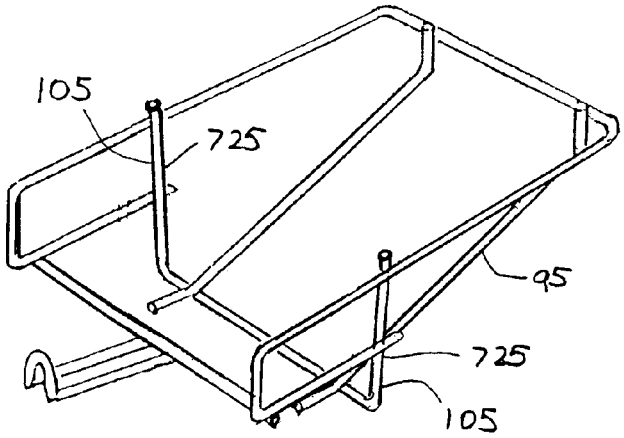
FIG. 16 is a perspective view of a dispenser wherein the means for constraining horizontal movement is an upright rod.

In another embodiment, illustrated in FIG. 16, the means for constraining movement 105 of the compact bag roll 65 along the horizontal axis 75 has at least one upright constraint rod 725. The rod 725 extends upwardly from the lower bag roll support 95, adjacent to a side 730 of the compact bag roll 65.

In yet another embodiment, illustrated in FIG. 13, the perforation parting means 110 has at least one second wire loop 735, extending upwardly from the lower bag roll support 95. The loop 735 is located at the horizontal axis 75 of the compact bag roll 65 so that an upper end 740 of the second wire loop 735 will engage the perforated severance line 40.

Figure 17:
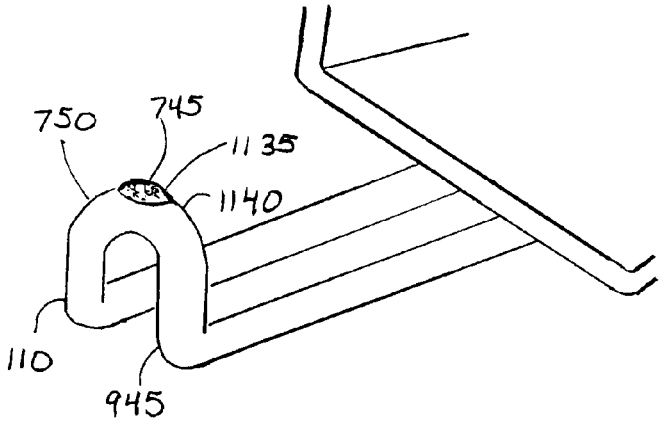
FIG. 17 is an exploded view of a dispenser wherein the perforation parting means has a frictional end piece.

In another variant of the invention, illustrated in FIG. 17, the perforation parting means 110 has a frictional end piece 745 which is mounted at an upper end 750 of the parting means 110. The end piece 745 is formed of material that adheres to plastic bag material to facilitate separation and opening of the first bag 50 from the subsequent bag 58.

Figure 18:
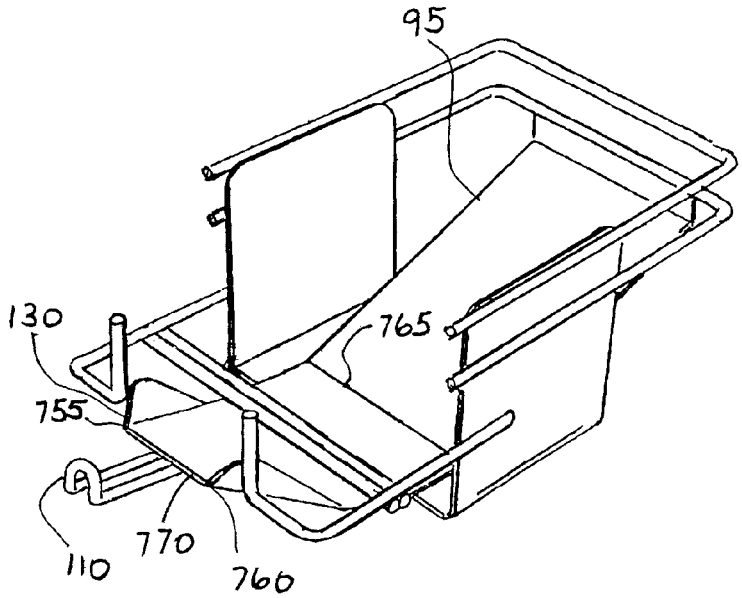
FIG. 18 is a perspective view of a dispenser that has a formed panel.

In another variant, illustrated in FIG. 18, the means for directing 130 the bags 15 from the bag roll 65 over the perforation parting means 110 has a first formed panel 755 which has a first end 760 and a second end 765. The panel 755 is attached at the second end 765 to the lower bag roll support 95. The first formed panel 755 has a guide slot 770 formed at the first end 760 which is sized, shaped and located to constrain a folded bag 15 and to direct the bag 15 over the perforation parting means 110.

Figure 19:
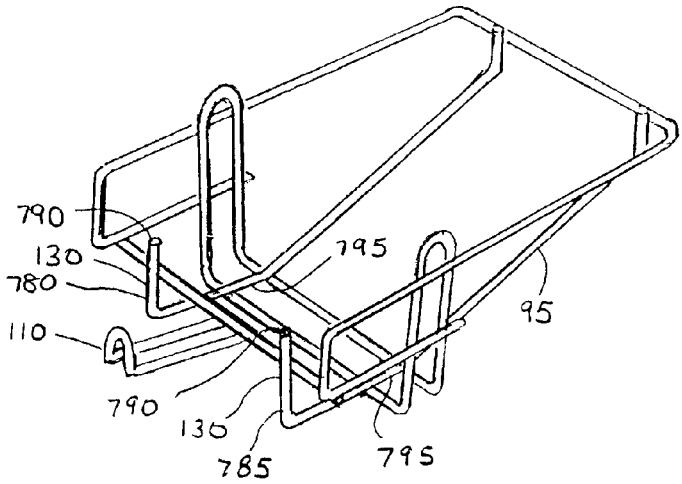
FIG. 19 is a perspective view of a dispenser wherein the means for channeling the bags over the perforation parting means are two directing members.

In yet another variant, illustrated in FIG. 19, the means for directing 130 the bags 15 from the bag roll 65 over the perforation parting means 110 has first 780 and second 785 directing members. The directing members 780, 785 have first 790 and second 795 ends and are mounted at the second ends 795 to the lower bag roll support 95. The ends 790, 795 are spaced outwardly from the horizontal axis 75 of the compact bag roll 65.

Figure 20:
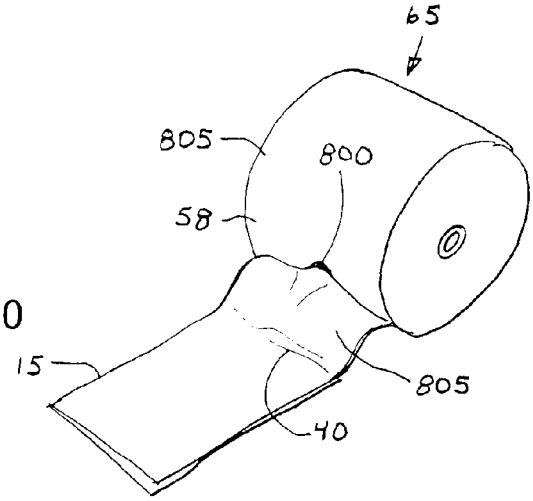
FIG. 20 is a perspective view of a compact bag roll that has an adhering means affixed to an outer surface of the bags.

In another embodiment of the invention, illustrated in FIG. 20, the bags 15 have an adhering means 800. The adhering means 800 is affixed to an outer surface 805 of the folded bag 15 such that the outer surface 805 will be removably affixed to the outer surface 805 of a subsequent bag 58 on the compact roll 65. The adhering means 800 causes the perforated severance line 40 of the outer surface 805 to part as bags 15 are pulled from the compact roll 65.

In another embodiment, the adhering means 800 is selected from the group that includes the application of heat and pressure, cold pressure, corona discharge treatment, and application of plastic solvents.

Figure 21:
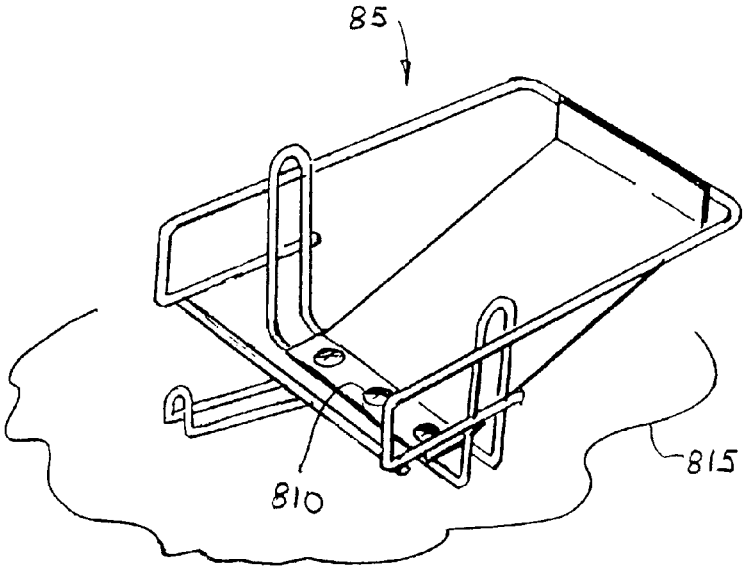
FIG. 21 is a perspective view of the dispenser that has a means for securing it to a surface.

In yet another embodiment, illustrated in FIG. 21, the dispenser 85 has a means 810 for securing the dispenser 85 to a surface 815.

In another variant of the invention, illustrated in FIGS. 22 and 23, the combination of rolled bags and dispenser 10 has a plurality of plastic bags 818. As illustrated in FIG. 8A, each of the bags 818 has first 820 and second 825 parallel linear side edges, a top edge 830 and a bottom edge 835. The bags 818 are joined along a perforated severance line 840 between the bottom edge 835 of a first bag 845 and the top edge 830 of a subsequent bag 850. The bags 818 are rolled about a horizontal axis 855 to form a compact bag roll 860 from which the bags 818 are dispensed and the compact bag roll 860 has a second predetermined width 865.

A dispenser 870 is provided, which includes a bag roll restraining means 875. The restraining means 875 extends across at least a portion of the second predetermined width 865. A lower bag roll support 880 is provided, which is located below the horizontal axis 885. A means 890 for constraining movement of the compact bag roll along the horizontal axis 885 is provided. A bag opening means 895 is provided, which has a mounting member 900 and a bag opening element 905.

The mounting member 900 has an upper end 910 and a lower end 915 and is sized, shaped and located to position the bag opening element 905 on or outward from the restraining means 875 at a level sufficient to engage an outer surface 920 of the outside bag 925 of the compact roll 860 as bags 818 are withdrawn from the roll 860.

The bag opening element 905 is located at the upper end 910 of the mounting member 900 and is formed of material which has a high coefficient of friction with respect to plastic bag material.

The compact bag roll 860 is located within the dispenser 870 with an outside bag 925 of the roll 860 extendable over the bag roll restraining means 875 and the bag opening means 895. When the outside bag 925 is pulled from the compact bag roll 860 across the bag opening means 895, the bag opening element 905 will retard the movement of an outermost layer 935 of the outside bag 925, causing the bag 925 to begin to open.

In another variant, illustrated in FIG. 23, each of the bags 15 are folded along at least one axis 60 parallel to the first 20 and second 25 parallel linear side edges.

In yet another variant, also illustrated in FIG. 23, the lower bag roll support 95 is shaped so as to urge the compact bag roll 65 toward the restraining means 90.

Figure 24:
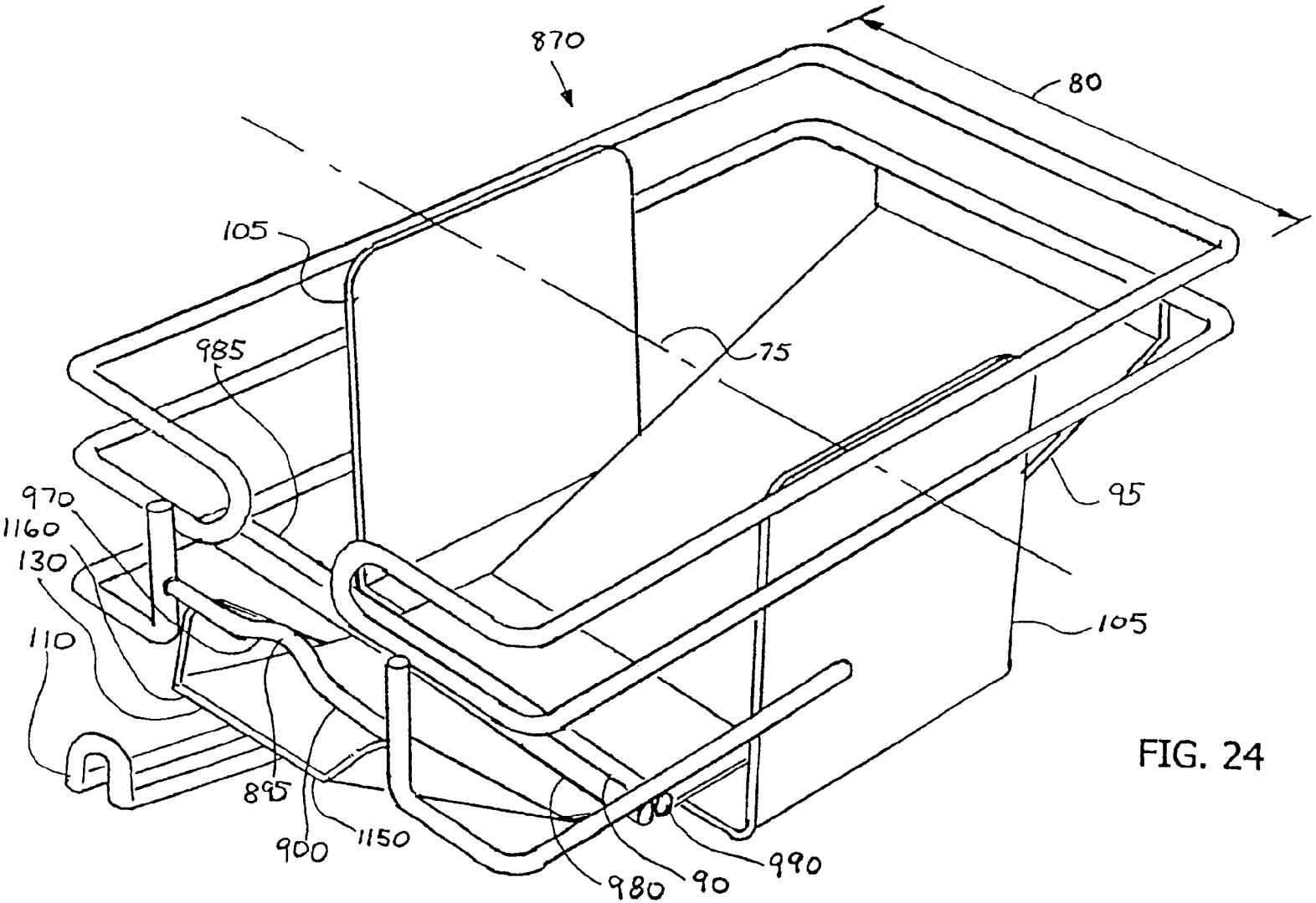
FIG. 24 is a perspective view of the preferred embodiment of the dispenser.

In another embodiment of the invention, illustrated in FIGS. 23 and 24, a perforation parting means is provided 110. The parting means 110 is sized, shaped and located to engage the perforated severance line 40 of bags 15 pulled from the compact bag roll 65. When the compact bag roll 65 is located within the dispenser 870, the first bag 50 is accessible for withdrawal from the dispenser 870 and the bags 15 may be serially withdrawn from the roll 65 with each subsequent bag 58 parted at the perforated severance line 40 by the perforation parting means 110.

In another embodiment, illustrated in FIG. 25, the bag opening means 895 is located between the restraining means 90 and the perforation parting means 110.

Figure 26:
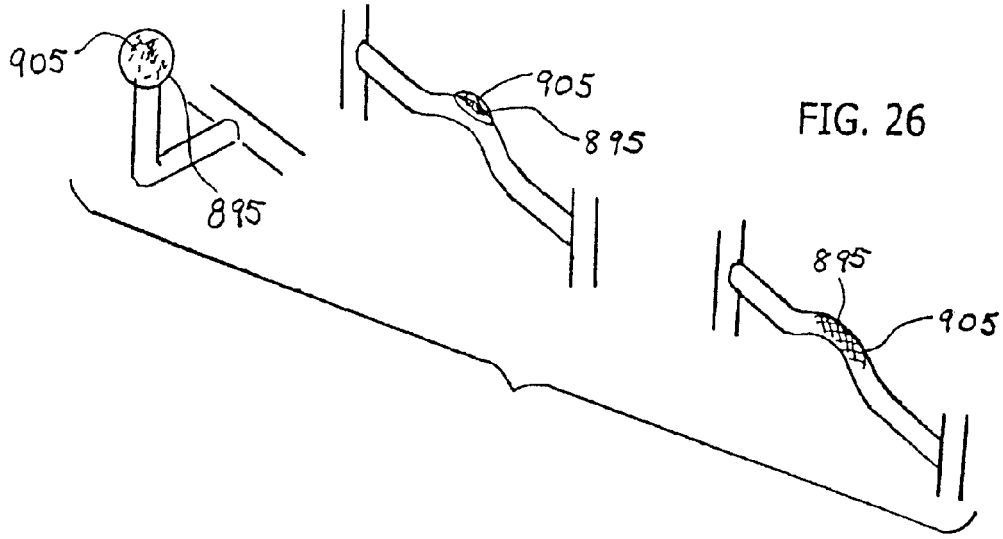
FIG. 26 is three exploded views which correspond to three different embodiments of the bag opening means comprising silicone, rubber and metal.

In yet another embodiment, illustrated in FIG. 26, the material of the bag opening element 905 is selected from the group that includes silicone 950, rubber 955, plastic 960 and metal 965.

Figure 27:
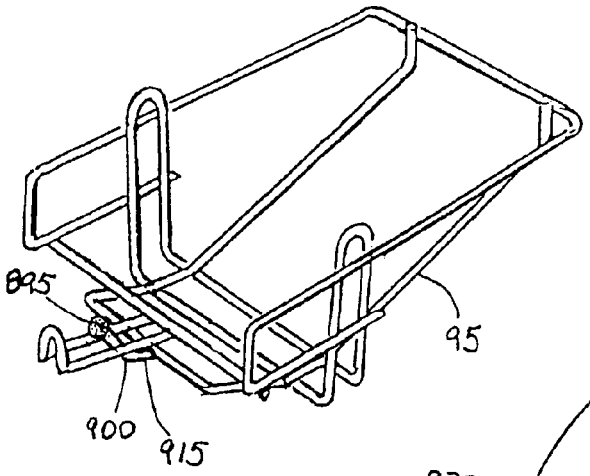
FIG. 27 is a perspective view of a dispenser wherein the lower end of the mounting member is attached to said lower bag roll support.

In another variant of the invention, illustrated in FIG. 27, the lower end 915 of the mounting member 900 is attached to the lower bag roll support 95.

Figure 28:
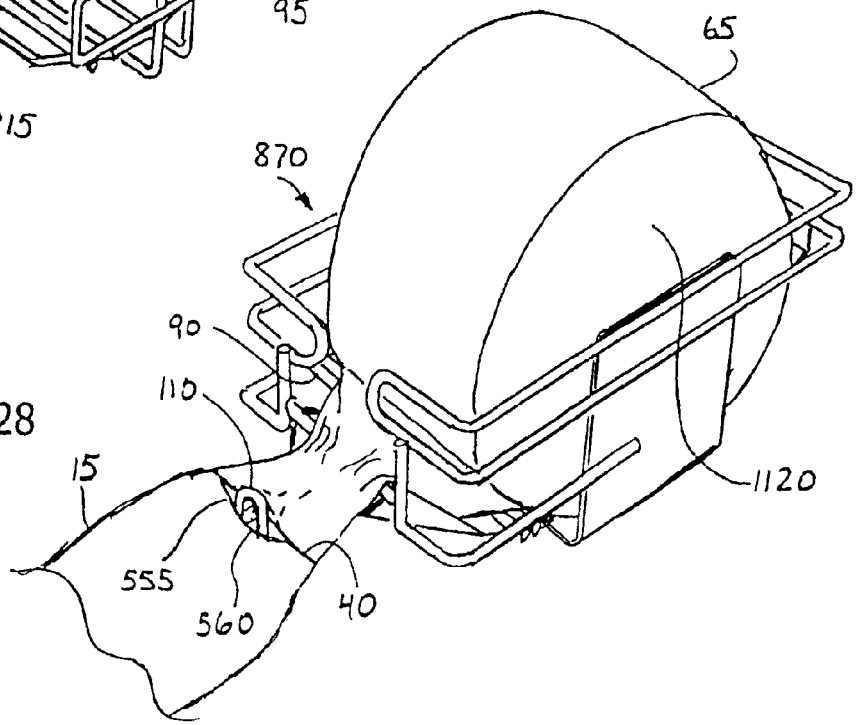
FIG. 28 is a perspective view of a combination plastic bag roll and dispenser as in FIG. 22 wherein each bag is a T-shirt style bag.

In another embodiment, illustrated in FIGS. 24 and 28, the mounting member 900 is disposed horizontally across the first predetermined width 80 of the bag roll 65. The bag opening element 905 is disposed at a central portion 970 of the mounting member 900 and extends upwardly therefrom.

In another variant, illustrated in FIGS. 24 and 28, a means 130 for directing the bags 15 from the bag roll 65 over the perforation parting means 110 is provided.

In yet another variant, illustrated in FIG. 24, the perforation parting means 110 extends outwardly beyond the restraining means 90.

In yet another variant, illustrated in FIG. 4, each bag 15 is a T-shirt style bag 135. Each bag 135 has a front panel 140 and a rear panel 145. Each front panel 140 has first 148 and second 150 parallel linear side edges, a top edge 155 and a bottom edge 160. Each rear panel 145 has first 162 and second 165 parallel linear side edges, a top edge 170 and a bottom edge 175.

Each T-shirt style bag 135 has two front gusset panels 180 of a first predetermined dimension 185. Each front gusset panel 180 has a top edge 188, a bottom edge 190, first 195 and second 200 parallel side edges. Each front gusset panel 180 is joined at the first side edge 195 to one of the linear side edges 148, 150 of the front panel 180 and extends from the top edge 188 of the front panel 180 to the bottom edge 190 thereof. Each bag 135 has two rear gusset panels 210 of the first predetermined dimension 185. Each rear gusset panel 210 has a top edge 215, a bottom edge 220, first 225 and second 230 parallel side edges. Each rear gusset panel 210 is joined at the first side edge 225 to one of the linear side edges 162, 165 of the rear panel 145 and extends from the top edge 155 of the front panel 140 to the bottom edge 160 thereof.

Continuing on in FIG. 4, each front gusset panel 180 also is joined to a respective one of the rear gusset panels 210 at its second side edge 230. Each of the front 180 and rear gusset panels 210 is folded inwardly relative to the front 140 and the rear 145 panels. The top edges 155, 170, 188, 215 of the front panel 140, the rear panel 145, the front gusset panels 180 and the rear gusset panels 210 terminate in an upper seam 235. The bottom edges 160, 175, 190, 220 of the front panel 140, the rear panel 145, the front gusset panels 180 and the rear gusset panels 210 terminate in a lower seam 240. The lower seam 240 is perpendicular to the linear side edges 148, 150, 162, 165 of the front 140 and rear panels 145.

A U-shaped cut-out 245 is provided, illustrated in FIG. 4. The cut-out 245 is located in an upper portion 250 of the bag 135 and commences at a first point 255 along the upper seam 235. The cut-out 245 is spaced inwardly from the first linear side edge 148, 162 and extends to a second point 256 along the upper seam 235 where the cut-out 245 is spaced inwardly from the second linear side edge 150, 165. The cut-out 245 extends downwardly toward the lower seam 240, forming an open mouth 258 and a pair of bag handles 260.

In another variant of the invention, illustrated in FIG. 5, each bag 15 is a star sealed bag 265. Each bag 265 has a front panel 270 and a rear panel 275. The front panel 270 has first 280 and second 285 parallel linear side edges, a top edge 290 and a bottom edge 295. The rear panel 275 has first 300 and second 305 parallel linear side edges, a top edge 310 and a bottom edge 315.

Each star sealed bag 265 has two front gusset panels 320 of a second predetermined dimension 325. Each front gusset panel 320 has a top edge 330, a bottom edge 335, inner 340 and outer 345 parallel side edges. Each front gusset panel 320 is joined at the outer side edge 345 to one of the linear side edges 280, 285 of the front panel 270 and extends from the top edge 290 of the front panel 270 to the bottom edge 295 thereof. The inner parallel side edges 340 of the front gusset panels 320 abut one another. Each bag 265 has two rear gusset panels 350 of the second predetermined dimension 325. Each rear gusset panel 350 has a top edge 355, a bottom edge 360, inner 365 and outer 370 parallel side edges. Each rear gusset panel 350 is joined at the outer side edge 370 to one of the linear side edges 300, 305 of the rear panel 275 and extends from the top edge 290 of the front panel 270 to the bottom edge 335 thereof. The inner parallel side edges 365 of the rear gusset panels 350 abut one another.

Continuing on in FIG. 5, each front gusset panel 320 also is joined to a respective one of the rear gusset panels 350 at the inner side edge 340, 365. Each of the front 320 and rear gusset panels 350 is folded inwardly relative to the front 270 and the rear panel 275. The front 270 and rear 275 panels are folded along a central axis 375 such that the first 280, 300 and second 285, 305 parallel linear side edges abut one another. The top edges 290, 310, 330, 355 of the front panel 270, the rear panel 275, the front gusset panels 320 and the rear gusset panels 350 terminate at the perforated severance line 840. The bottom edges 295, 315, 335, 360 of the front panel 270, the rear panel 275, the front gusset panels 320 and the rear gusset panels 350 terminate in a lower seam 380. The lower seam 380 is perpendicular to the linear side edges 280, 285, 300, 305 of the front 270 and rear 275 panels and seals together eight layers, which include the front 270 and rear 275 panels and the front 320 and rear 350 gusset panels. When the bag 265 is opened, the lower seam 380 will cause the bag 265 to have a star sealed bottom 385.

In another variant of the invention, illustrated in FIG. 6, each bag 15 is a star sealed bag with T-shirt style handles 390. Each bag 390 has a front panel 395 and a rear panel 400. The front panel 395 has first 405 and second 410 parallel linear side edges, a top edge 415 and a bottom edge 420. The rear panel 400 has first 425 and second 430 parallel linear side edges, a top edge 435 and a bottom edge 440.

Each bag 390 has two front gusset panels 445 of a third predetermined dimension 450. Each front gusset panel 445 has a top edge 455, a bottom edge 460, inner 465 and outer 470 parallel side edges. Each front gusset panel 445 is joined at the outer side edge 470 to one of the linear side edges 405, 410 of the front panel 395 and extends from the top edge 415 of the front panel 395 to the bottom edge 420 thereof. The inner parallel side edges 465, 470 of the front gusset panels 445 are spaced from one another by a first predetermined distance 475. Each bag 390 has two rear gusset panels 480 of the third predetermined dimension 450. Each rear gusset panel 480 has a top edge 485, a bottom edge 490, inner 495 and outer 500 parallel side edges. Each rear gusset panel 480 is joined at the outer side edge 500 to one of the linear side edges 425, 430 of the rear panel 400 and extends from the top edge 415 of the front panel 395 to the bottom edge 420 thereof. The inner parallel side edges 495 of the rear gusset panels 480 are spaced from one another by the first predetermined distance 475. Each front gusset panel 445 also is joined to a respective one of the rear gusset panels 480 at the inner side edge 465, 495. Each of the front 445 and rear 480 gusset panels is folded inwardly relative to the front 395 and the rear 400 panel. The top edges of the front panel 415, the rear panel 435, the front gusset panels 455 and the rear gusset panels 485 terminate in an upper seam 505 below the perforated severance line 40.

Continuing on in FIG. 6, each bag 390 has a U-shaped cut-out 510. The U-shaped cut-out 510 is located in an upper portion 515 of the bag 390. The cut-out 510 commences at a first point 520 along the upper seam 505 spaced inwardly from the first linear side edge 405, 425 and extends to a second point 522 along the upper seam 505 spaced inwardly from the second linear side edge 410, 430. The cut-out 510 extends downwardly toward a lower seam 525, thereby forming an open mouth 530 and a pair of bag handles 535. The front 395 and rear 400 panels are folded along a central axis 540 such that the first 405, 425 and second 410, 430 parallel linear side edges abut one another. The bottom edges 420, 440, 460, 490 of the front panel 395, the rear panel 400, the front gusset panels 445 and the rear gusset panels 480 terminate in the lower seam 525. The lower seam 525 is perpendicular to the linear side edges 405, 410, 425, 430 of the front 395 and rear 400 panels and seals together eight layers, which include the front 395 and rear 400 panels and the front 445 and rear 480 gusset panels. When the bag 390 is opened the lower seam 525 will cause the bag 390 to have a star sealed bottom 550.

In another variant, illustrated in FIGS. 7 and 28, each bag 15 has a chisel cut 555. The cut 555 penetrates the perforated severance line 40 and is located thereon so as to align with the perforation parting means 945 of the dispenser 870.

In yet another variant, illustrated in FIG. 8, the perforated severance line 40 is formed of a series of alternating cuts 560 and perforations 565, with at least one of the cuts 560 located so as to align with the perforation parting means 110.

In yet another variant, illustrated in FIGS. 24 and 28, the bag roll restraining means 90 has a horizontal bar 980. The horizontal bar 980 has a first end 985 and a second end 990 and is located parallel to the horizontal axis 75 of the bag roll 65. The horizontal bar 980 is attached at least one end 985, 990 to the means 890 for constraining movement of the compact bag roll 65 along the horizontal axis 75.

Figure 29:
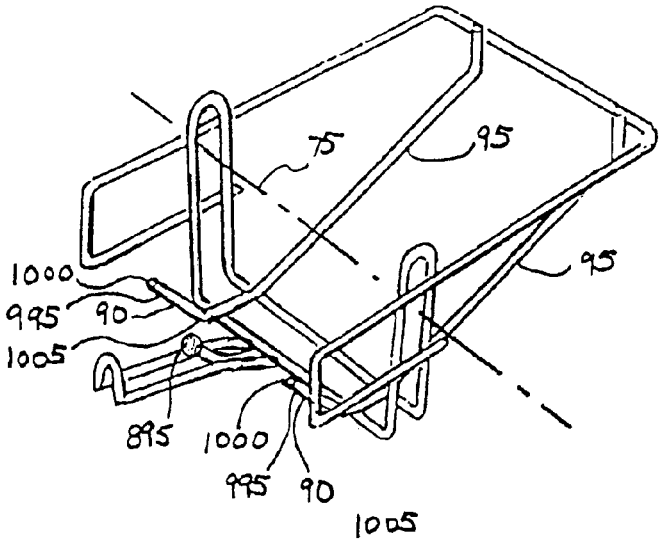
FIG. 29 is a perspective view of a dispenser as in FIG. 22 wherein the bag roll restraining means is an upright post.

In another embodiment of the invention, illustrated in FIGS. 28 and 29, the bag roll restraining means 90 has at least one upright post 995, which has an upper end 1000 and a lower end 1005. The post 995 is spaced from the horizontal axis 75 of the compact bag roll 65 and located to bear at its upper end 1000 against the outside bag 925 of the roll 65 as the roll 65 is urged toward the post 995 by the lower bag roll support 95. The post 995 is attached at its lower end 1005 to the lower bag roll support 95.

Figure 30:
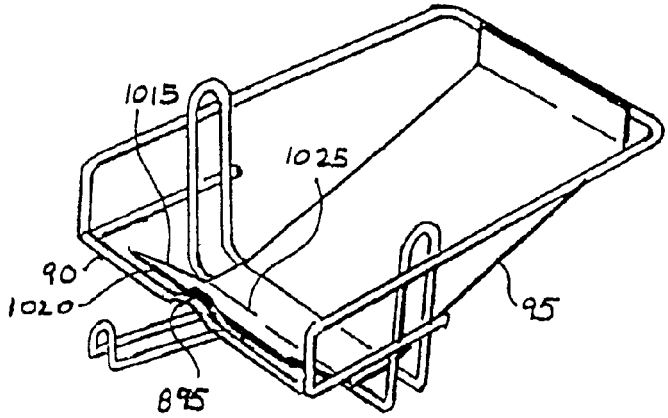
FIG. 30 is a perspective view of a dispenser as in FIG. 22 wherein the bag roll restraining means is an angled plate.

In another embodiment, illustrated in FIGS. 28 and 30, the bag roll restraining means 90 has a first angled plate 1015. The plate 1015 has an upper end 1020 and a lower end 1025 and is sized, shaped and located to bear against the outside bag 925 of the roll 65 as the roll 65 is urged toward the angled plate 1015 by the lower bag roll support 95. The angled plate 1015 is attached at its lower end 1025 to the lower bag roll support 95.

Figure 31:
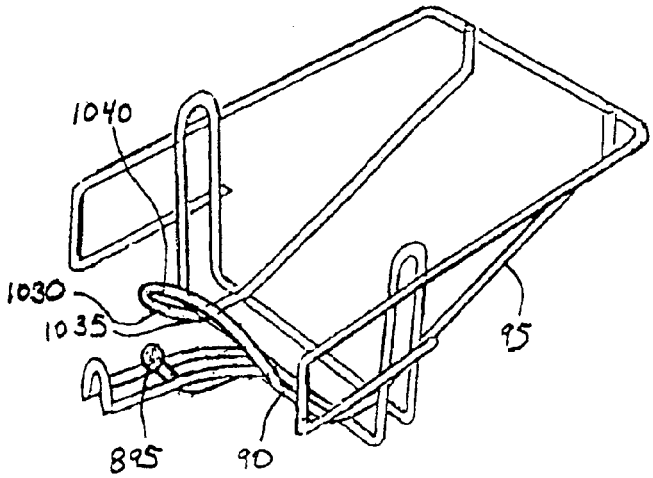
FIG. 31 is a perspective view of a dispenser as in FIG. 22 wherein the bag roll restraining means is a wire loop.

In yet another embodiment, illustrated in FIGS. 28 and 31, the bag roll restraining means 90 has at least one first wire loop 1030, which has a lower end 1035 and a curved upper end 1040. The loop 1030 is spaced from the horizontal axis 75 of the compact bag roll 65 and is sized, shaped and located to bear against the outside bag 925 of the roll 65 as the roll 65 is urged forward by the lower bag roll support 95. The wire loop 1030 is attached at its lower end 1035 to the lower bag roll support 95.

Figure 32:
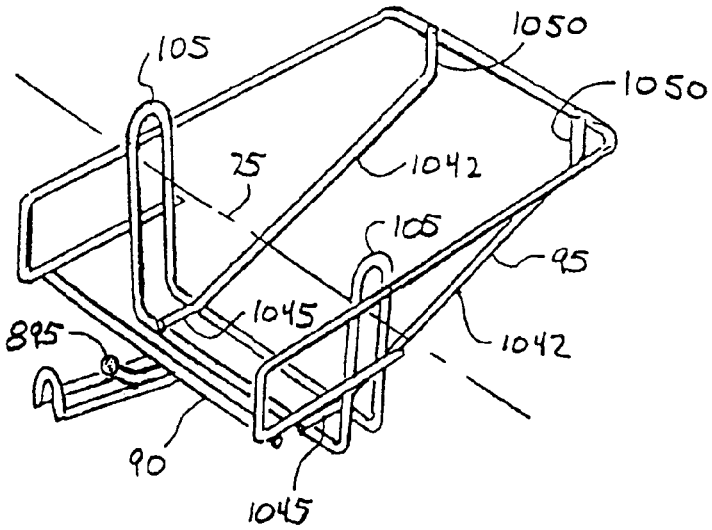
FIG. 32 is a perspective view of a dispenser as in FIG. 22 wherein the lower bag roll support is two angled bars.

In another variant of the invention, illustrated in FIGS. 28 and 32, the lower bag roll support 95 has at least two angled bars 1042, which have a first end 1045 and a second end 1050 and are located below the horizontal axis 75 of the compact bag roll 65. The bars 1042 are aligned so as to urge the compact bag roll 65 toward the restraining means 90. The bars 1042 are attached at the first end 1045 to the means 105 for constraining movement of the compact bag roll 65 along the horizontal axis 75.

Figure 33:
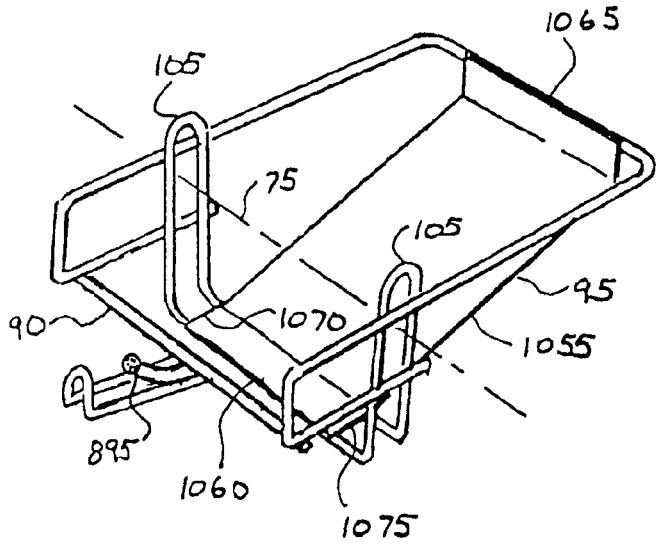
FIG. 33 is a perspective view of a dispenser as in FIG. 22 wherein the lower bag roll support is an angled plate.

In another variant, illustrated in FIGS. 28 and 33, the lower bag roll support 95 has a second angled plate 1055, which has a first end 1060, a second end 1065, first 1070 and second 1075 sides and is located below the horizontal axis 75 of the compact bag roll 65. The plate 1055 is aligned so as to urge the compact bag roll 65 toward the restraining means 90. The plate 1055 is attached at the first 1070 and second 1075 side to the means for constraining movement 105 of the compact bag roll 65 along the horizontal axis 75 and attached at the second end 1065 to the bag roll restraining means 90.

In yet another variant, illustrated in FIGS. 28 and 34, the lower bag roll support 95 has a first curved plate 1080, which has a first end 1085, a second end 1090, first 1095 and second 1100 sides and is located below the horizontal axis 75 of the compact bag roll 65. The plate 1080 is aligned so as to urge the compact bag roll 65 toward the restraining means 90. The plate 1080 is attached at the first 1095 and second 1100 sides to the means for constraining movement 105 of the compact bag roll 65 along the horizontal axis 75 and attached at the second end 1090 to the bag roll restraining means 90.

Figure 34:
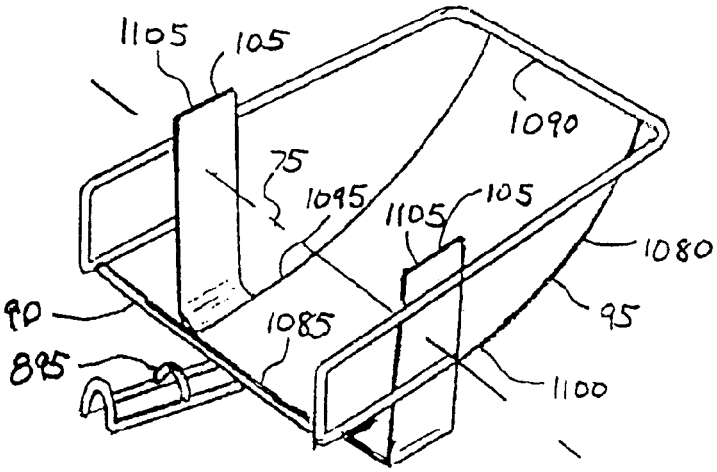
FIG. 34 is a perspective view of a dispenser as in FIG. 22 wherein the lower bag roll support is a curved plate and the means for constraining movement along the horizontal axis is two vertical walls.

In another embodiment of the invention, also illustrated in FIGS. 28 and 34, the means for constraining movement 105 of the compact bag roll 65 along the horizontal axis 75 has at least one vertical side wall 1105, which is located orthogonally to the horizontal axis 75 of the compact bag roll 65 and attached at a lower edge 1110 to the lower bag roll support 95.

Figure 35:
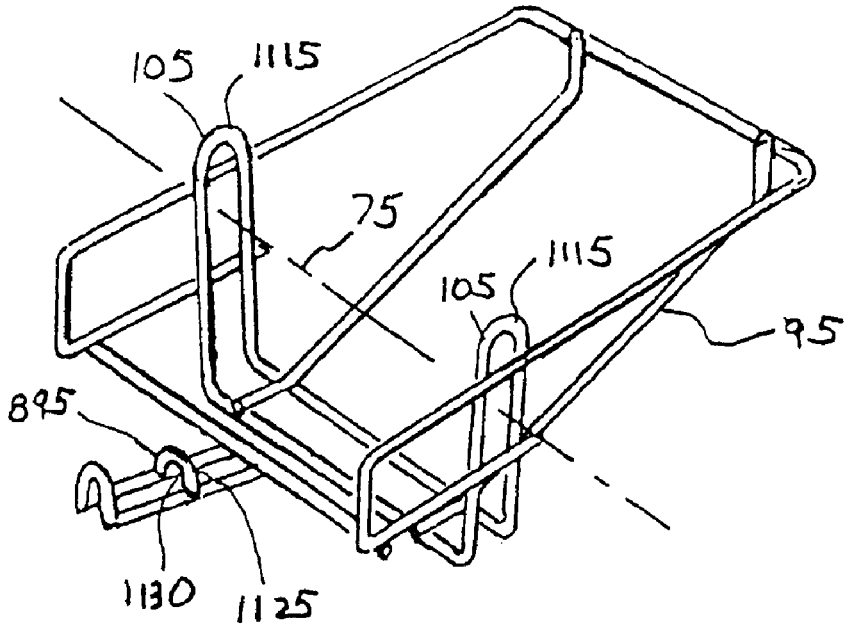
FIG. 35 is a perspective view of a dispenser as in FIG. 24 wherein the perforation parting means has a second wire loop.

In another embodiment, as illustrated in FIGS. 28 and 35, the means for constraining movement 105 of the compact bag roll 65 along the horizontal axis 75 has at least one upright constraint rod 1115, which extends upwardly from the lower bag roll support 95, adjacent a side 1120 of the compact bag roll 65.

In yet another embodiment, also illustrated in FIG. 35, the perforation parting means 110 has at least one second wire loop 1125. The loop 1125 extends upwardly from the lower bag roll support 95 and is located at the horizontal axis 75 of the compact bag roll 65 so that an upper end 1130 of the second wire loop 1125 will engage the perforated severance line 40.

In another variant of the invention, as illustrated in FIG. 17, the perforation parting means 110 has a frictional end piece 1135, which is mounted at an upper end 1140 of the perforation parting means 110. The end piece 1135 is formed of material that adheres to plastic bag material to facilitate separation and opening of the first bag 50 from the subsequent bag 58.

In another variant, illustrated in FIGS. 23 and 24, the means for directing 975 the bags 15 from the bag roll 65 over the perforation parting means 110 has a first formed panel 1145, which has a first end 1150, a second end 1155 (not shown) and is attached at the second end 1155 (not shown) to the lower bag roll support 95. The panel 1145 has a guide slot 1160 formed at the first end 1150, which is sized, shaped and located to constrain a folded bag 15 and to direct the bag 15 over the perforation parting means 110.

Figure 36:
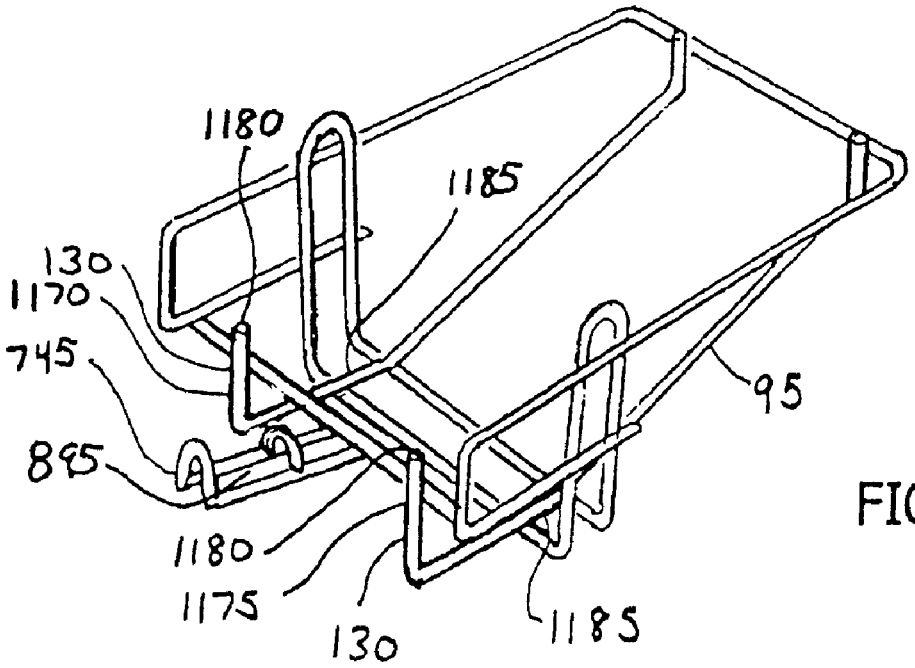
FIG. 36 is a perspective view of a dispenser as in FIG. 22 wherein the means for directing said bags from said bag roll over said perforation parting means is first and second directing members.
Figure 37:
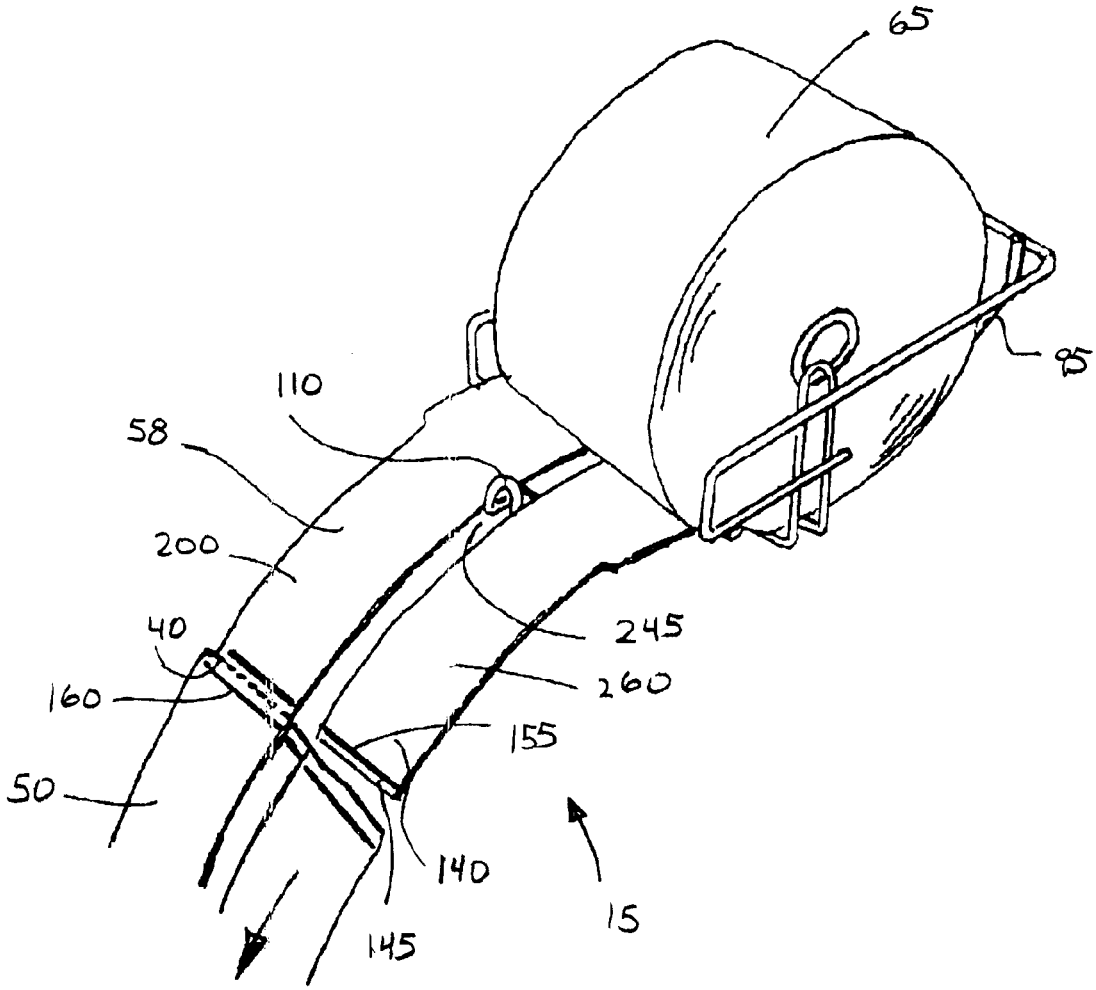
FIG. 37 is a perspective view of a dispenser with folded T-shirt style bags being dispensed from a roll.

In yet another variant, illustrated in FIGS. 28 and 36, the means for directing the bags 130 from the bag roll 65 over the perforation parting means 110 has first 1170 and second 1175 directing members, which have first 1180 and second 1185 ends and are mounted at the second ends 1185 to the lower bag roll support 95 and are spaced outwardly from the horizontal axis 75 of the compact bag roll 65.

Further variants of the invention (not shown) include a tray-like dispenser 1190, a dispenser 1195 with glue tabs 1200 for mounting to a surface 1205, a dispenser 1210 with weighted mounting feet 1215, and a dispenser 1220 designed to be mounted under a counter 1225.

Figure 38:
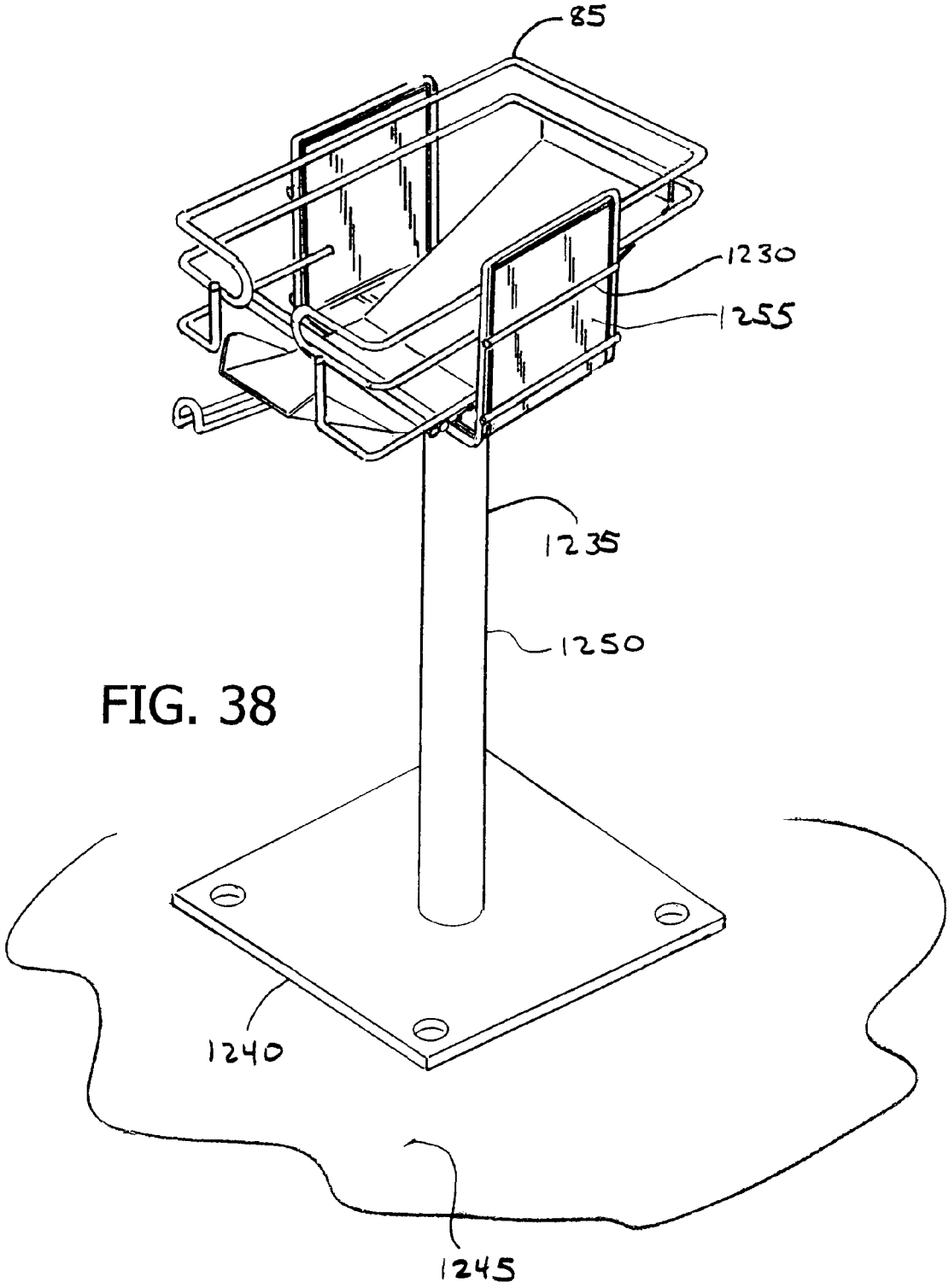
FIG. 38 is a perspective view of a dispenser as in FIG. 2 wherein a dispenser support attachment is provided to attach the dispenser to a surface.

In another embodiment of the invention, as illustrated in FIG. 38, a dispenser support attachment means 1230 is provided. The attachment means 1230 is affixed to the dispenser 85. A dispenser support 1235 is also provided. The dispenser support 1235 has a means 1240 for attaching to a surface 1245, an extension means 1250 and a means 1255 for removably attaching to the dispenser support attachment means 1230.

Figure 39:
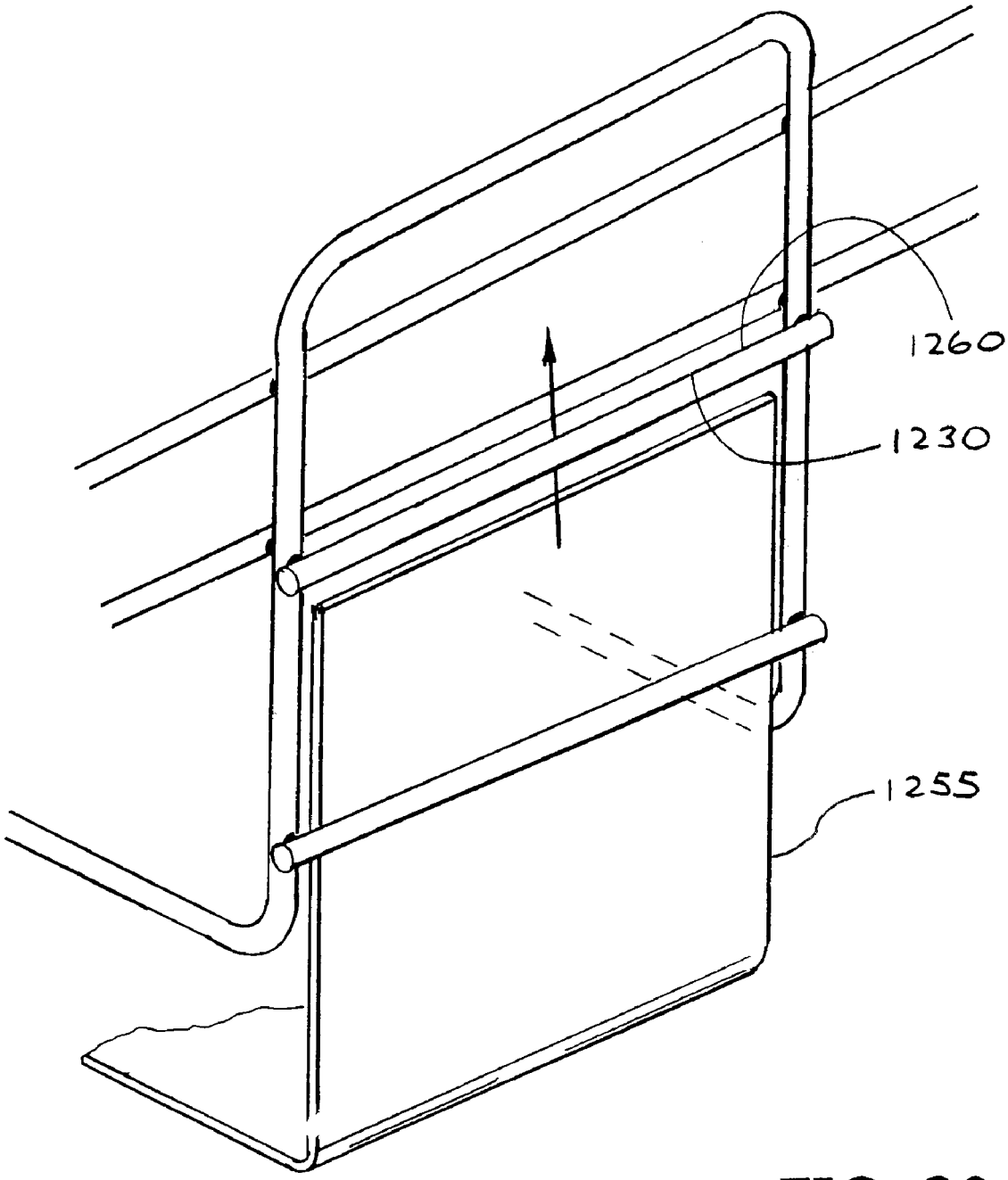
FIG. 39 is a detailed perspective view of a dispenser as in FIG. 2 and support attachment means wherein the attachment means has at least one receiving bracket to accept means for removably attaching to the dispenser attachment means.

In another embodiment, as illustrated in FIG. 39, the dispenser support attachment means 1230 has at least one receiving bracket 1260 that is sized, shaped and located to accept the means 1255 for removably attaching to the dispenser attachment means 1230.

Figure 40:
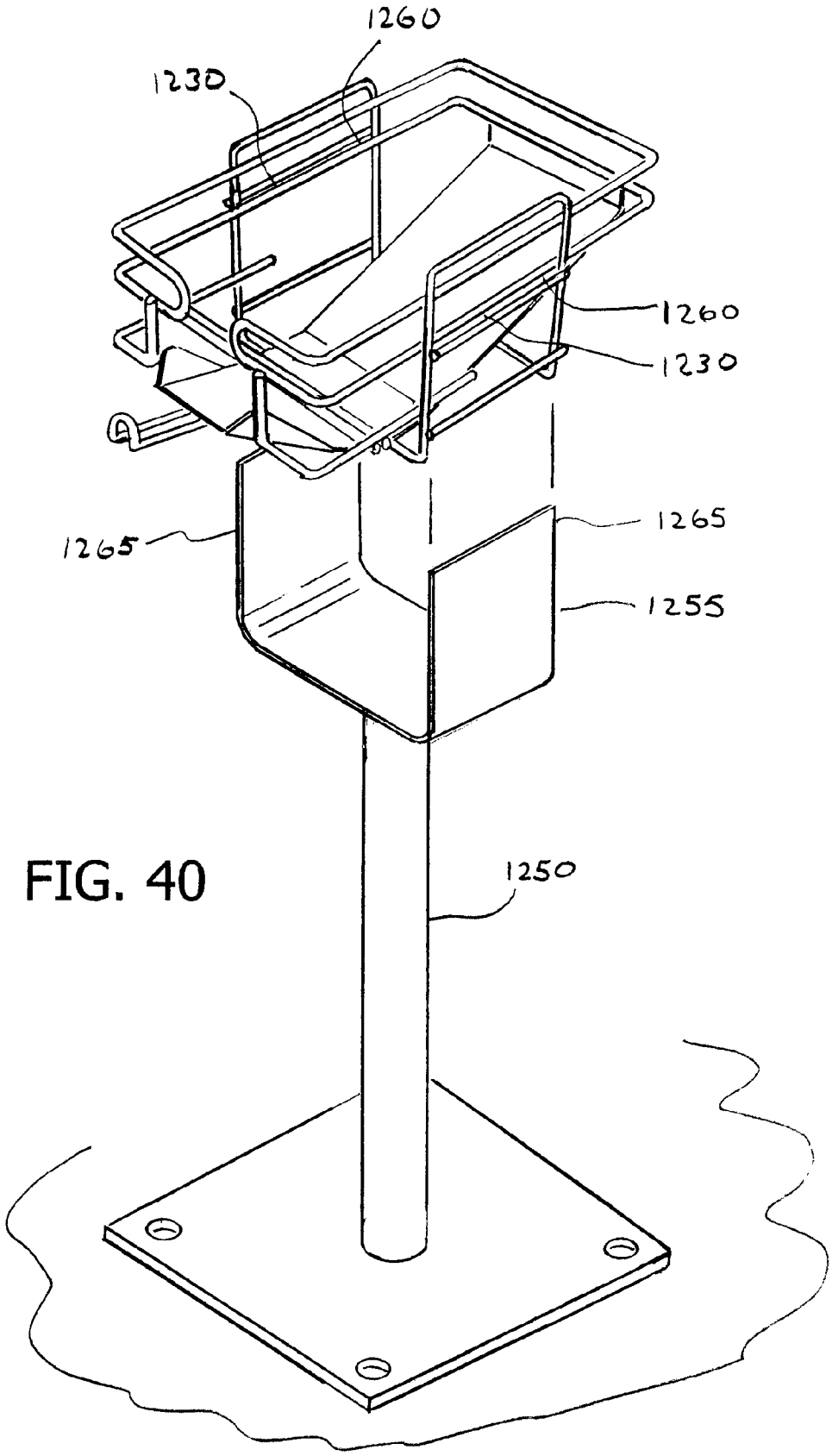
FIG. 40 is an exploded perspective view of a dispenser support attachment as shown in FIG. 38.

In yet another embodiment, as illustrated in FIG. 40, the means 1255 for removably attaching to the dispenser attachment means 1230 has at least one engagement tab 1265 which is attached to the extension means 1250 and is sized, shaped, and located to fit frictionally into the receiving bracket 1260.

Figure 41:
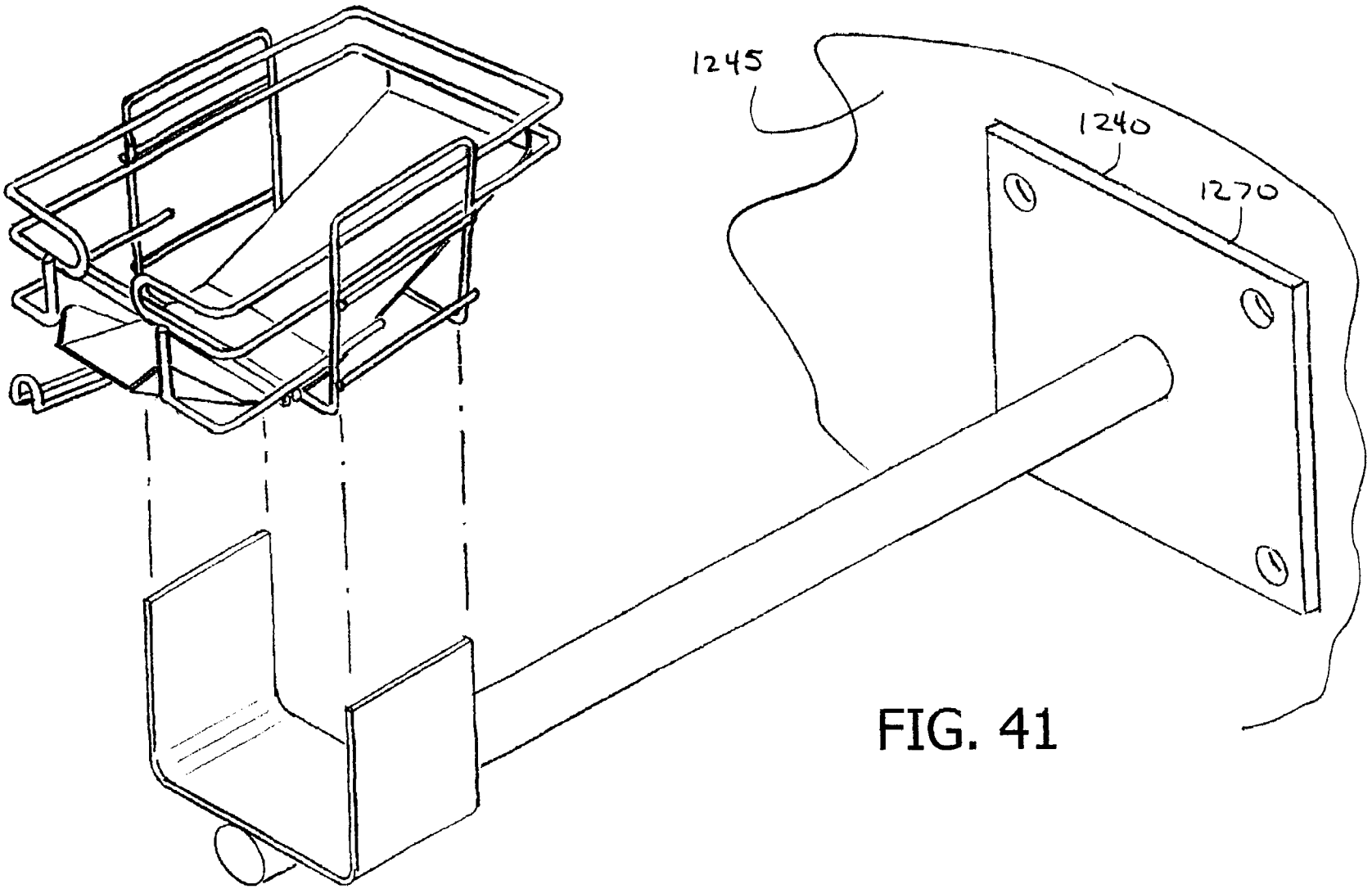
FIG. 41 is a perspective view of a dispenser as in FIG. 2 and support attachment means wherein the means for attaching to a surface is a wall mounting.

In another variant of the invention, as illustrated in FIG. 41, the means 1240 for attaching to a surface 1245 is a wall mounting 1270.

Figure 42:
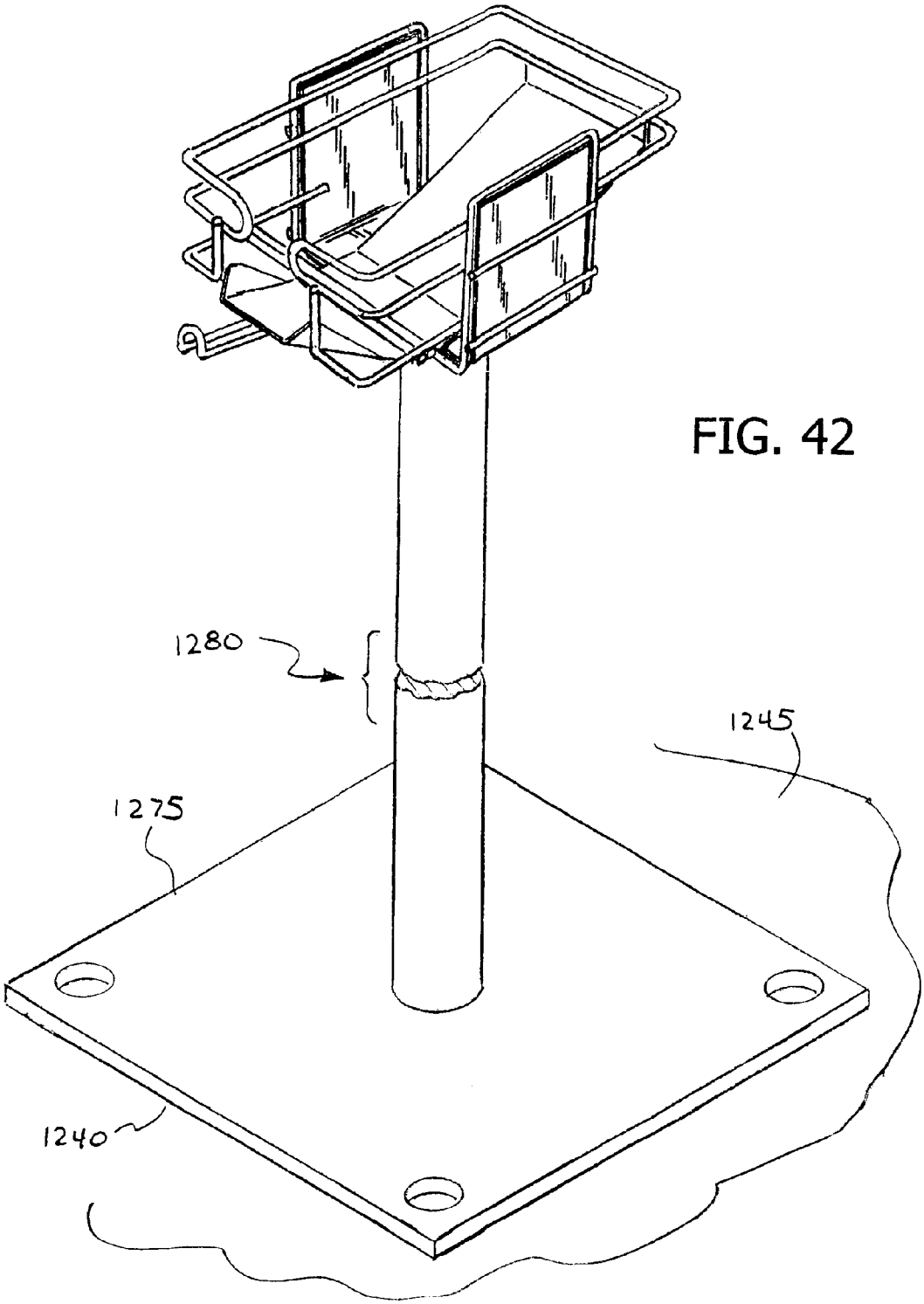
FIG. 42 is a perspective view of a dispenser as in FIG. 2 and support attachment means wherein the means for attaching to a surface is either a floor mounting or a counter mounting.

In another variant, as illustrated in FIG. 42, the means 1240 for attaching to a surface 1245 is either a floor mounting 1275 or a counter mounting 1280.

Figure 43:
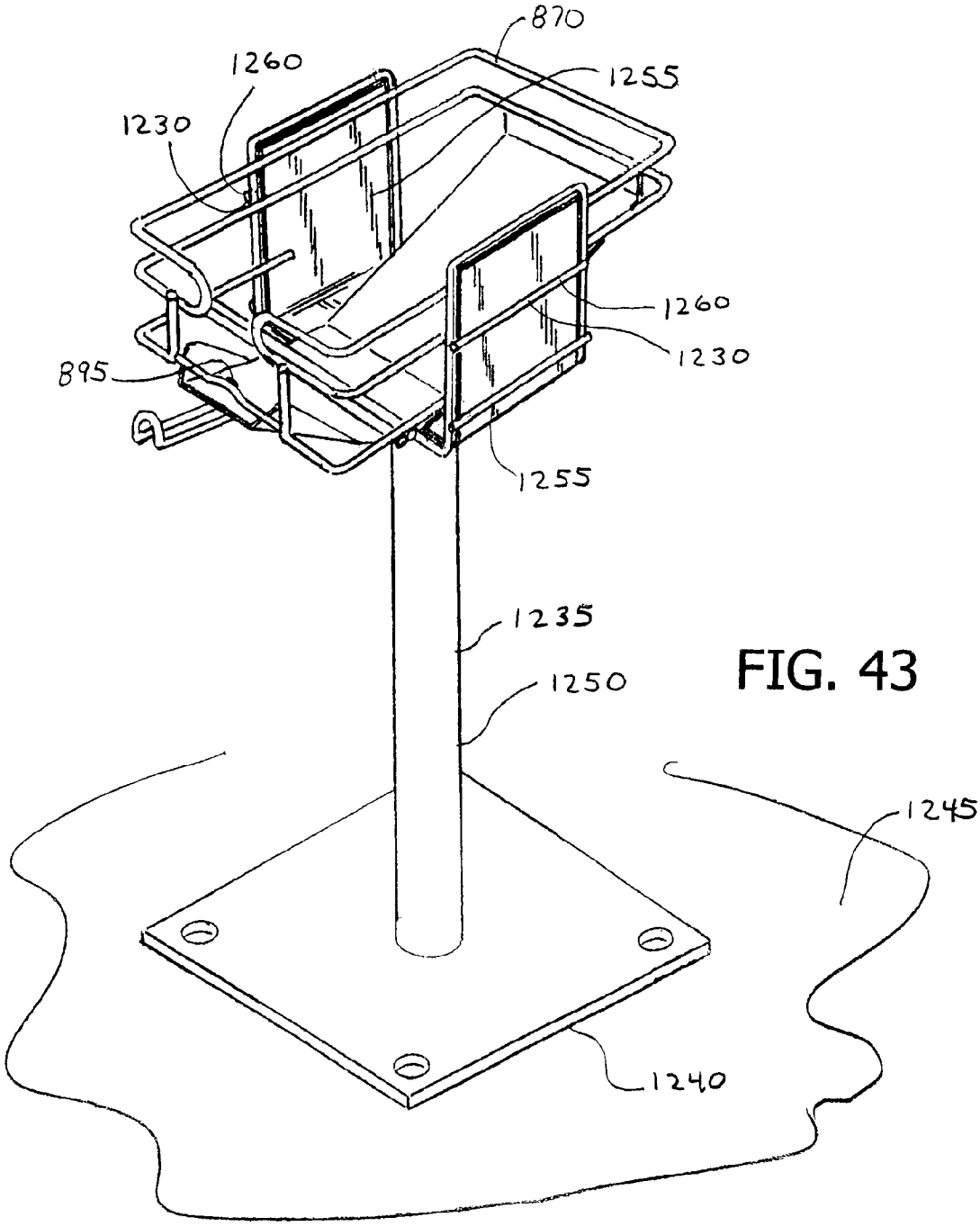
FIG. 43 is a perspective view of a dispenser as in FIG. 24 and support attachment means wherein the support has at least one receiving bracket to accept the means for removably attaching to the dispenser attachment means.

In yet another variant, as illustrated in FIG. 43, a dispenser support attachment means is provided 1230. The attachment means 1230 is affixed to the dispenser 870. A dispenser support 1235 is also provided. The dispenser support 1235 has a means 1240 for attaching to a surface 1245, an extension means 1250 and means 1255 for removably attaching to the dispenser attachment means 1230.

In another embodiment of the invention, as illustrated in FIG. 43, the dispenser support attachment means 1230 has at least one receiving bracket 1260 which is sized, shaped and located to accept the means 1255 for removably attaching to the dispenser attachment means 1230.

Figure 44:
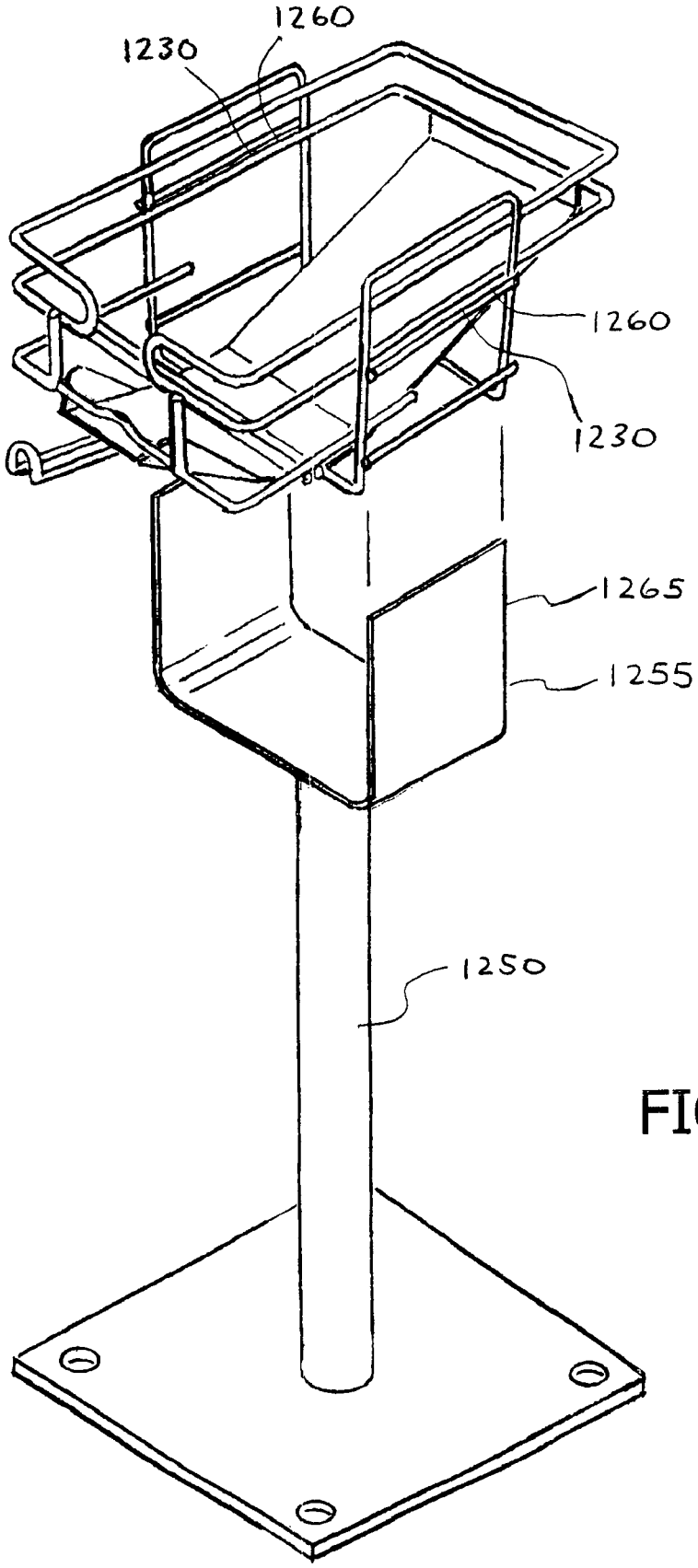
FIG. 44 is an exploded perspective view of a dispenser and support attachment as shown in FIG. 43.

In another embodiment, as illustrated in FIG. 44, the means 1255 for removably attaching to said dispenser attachment means 1230 has at least one engagement tab 1265 which is attached to the extension means 1250 and is sized, shaped, and located to fit frictionally into the receiving bracket 1260.

Figure 45:
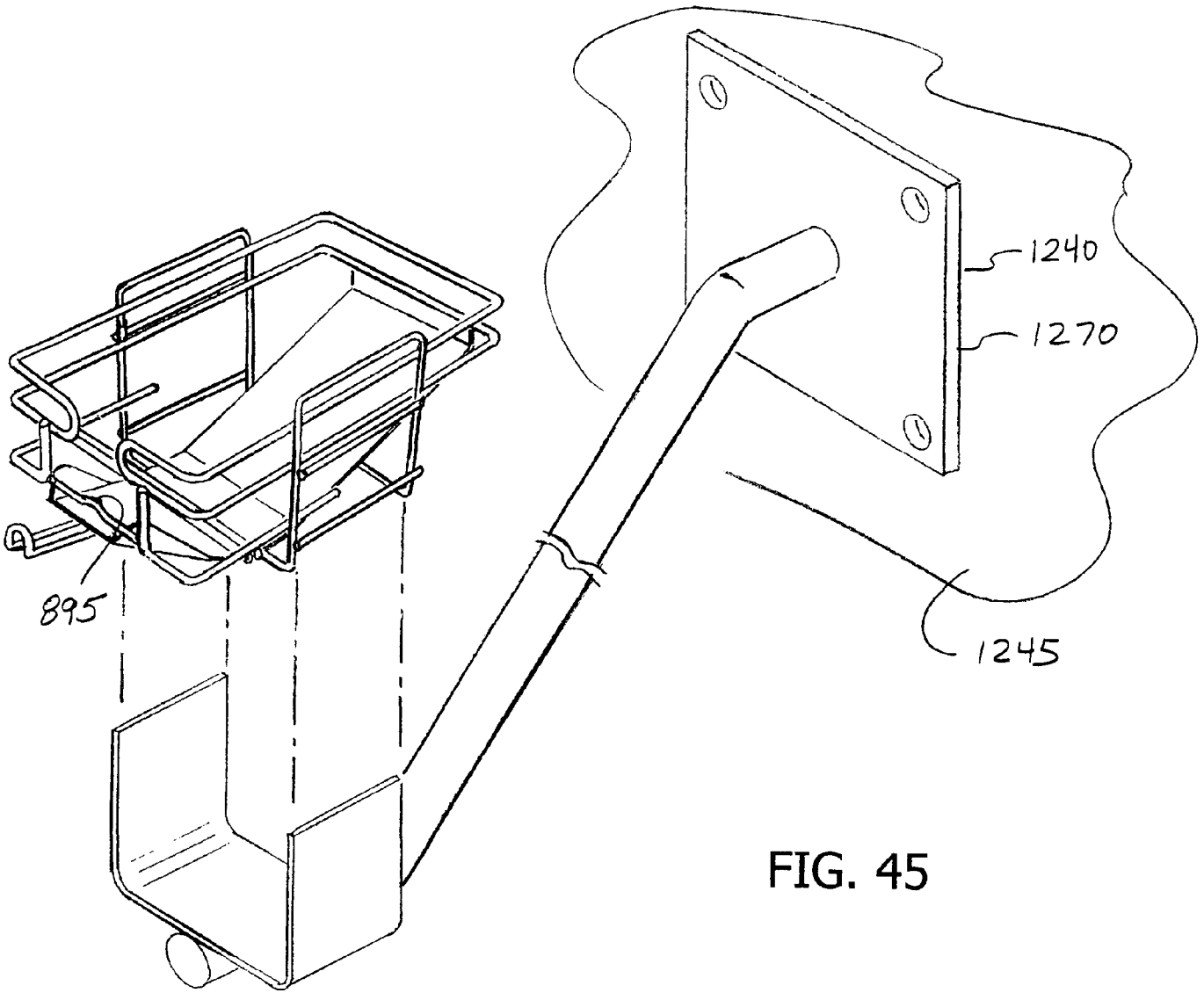
FIG. 45 is an exploded perspective view of a dispenser as in FIG. 24 and support attachment means wherein the means for attaching to a surface is an angles wall mounting.

In yet another embodiment, as illustrated in FIG. 45, the means 1240 for attaching to a surface 1245 is a wall mounting 1270.

Figure 46:
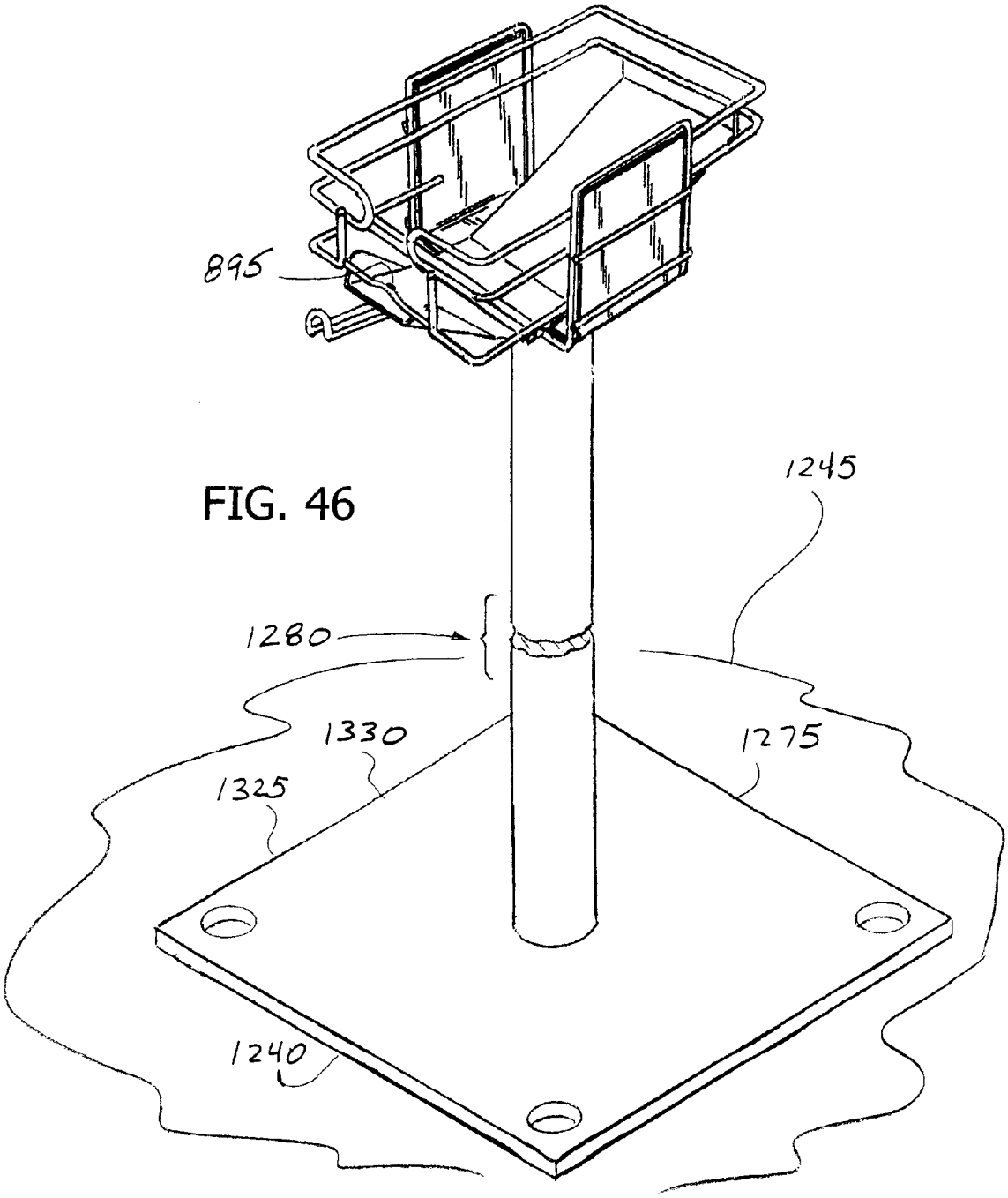
FIG. 46 is a perspective view of a dispenser as in FIG. 24 and support attachment means wherein the means for attaching to a surface is either a floor mounting or a counter mounting.

In still another variant, as illustrated in FIG. 46, the means 1240 for attaching to a surface 1245 is either of a floor mounting 1275 or a counter mounting 1280.

(1) In a further variant of the invention, as shown in FIGS. 1, 2 and 3, a dispensing system 10 includes a wire frame 87, a lower bag roll support 95, a constraining movement element 105, a bag roll restraining means 90 and a perforation parting means 110. The frame 87 includes four corners 89 each of approximately 90 degrees, has a C shape in a horizontal plane, and includes a dispensing end 102, a back end 104, and two sides 106. The lower bag roll support 95 includes a proximal end 125 and a distal end 127. The distal end 127 is attached to the back end 104 of the frame 87, and the lower bag roll support 95 extends angularly downward from the distal end 127 toward the proximal end 125. The constraining movement element 105 is attached to the two sides 106 of the wire frame 87, and has two, approximately 90 degree angles that form side panels. Adjacent to the proximal end 125 of the lower bag roll support 95 the bag roll restraining means 90 is attached to both of the sides 106 of the frame 87 and the perforation parting means 110 is located adjacent the proximal end 125.

A plurality of plastic bags 15, as illustrated in FIGS. 4-8, is provided. Each of the bags 15 has first 20 and second 25 parallel linear side edges, a top edge 30 and a bottom edge 35. The bags 15 are joined along a perforated severance line 40 between the bottom edge 35 of a first bag 50 and the top edge 30 of a subsequent bag 58. The bags 15 are rolled about a horizontal axis 75 to form a bag roll 65 from which the bags 15 are dispensed. The bag roll 65 has a first predetermined width 80 narrower than a distance 109 between the side panels. When the bag roll 65 is located within the dispenser 85 with the first bag 50 is accessible for withdrawal from the dispenser 85, the bags 15 may be serially withdrawn from the roll 65 with each subsequent bag 58 being parted at the perforated severance line 40.

(2) In still a further variant, as illustrated in FIG. 2, means 130 are provided for directing the bags 15 from the bag roll 65 over the perforation parting means 110.

(3) In yet a further variant, the perforation parting means 110 extends outwardly beyond the bag roll restraining means 90.

(4) In another variant of the invention, as illustrated in FIG. 7, each bag further includes a chisel cut 555, the chisel cut 555 penetrating the perforated severance line 40 and is located thereon so as to align with the perforation parting means 110 of the dispenser 85.

(5) In still another variant, as illustrated in FIG. 8, the perforated severance line 40 is formed of a series of alternating cuts 560 and perforations 565, at least one of the cuts 560 is located so as to align with the perforation parting means 110.

(6) In yet another variant, as illustrated in FIGS. 4-8, each of the bags 15 is folded along at least one axis 60 parallel to the first 20 and second 25 parallel linear side edges.

(7) In a further variant, elements that make up the frame 87 are substantially circular in cross-section.

(8) In still a further variant, elements that make up the frame 87 are substantially rectangular in cross-section.

(9) In yet a further variant, elements that make up the frame 87 are substantially triangular in cross-section.

(10) In another variant of the invention, as shown in FIGS. 1, 2 and 3, a dispensing system 10 includes a wire frame 87, a lower bag roll support 95, a constraining movement element 105, a bag roll restraining means 90 and a perforation parting means 110. The frame 87 includes four corners 89 each of approximately 90 degrees, has a C shape in a horizontal plane, and includes a dispensing end 102, a back end 104, and two sides 106. The lower bag roll support 95 includes a proximal end 125 and a distal end 127. The distal end 127 includes a plurality of angled corners 129. The distal end 127 is attached to the back end 104 of the frame 87, and the lower bag roll support 95 extends angularly downward from the distal end 127 toward the proximal end 125. The constraining movement element 105 is attached to the two sides 106 of the wire frame 87, and has two, approximately 90 degree angles that form side panels. Adjacent to the proximal end 125 of the lower bag roll support 95, the bag roll restraining means 90 is attached to the frame 87. The perforation parting means 110 is located adjacent the proximal end 125.

A plurality of plastic bags 15, as illustrated in FIGS. 4-8, is provided. Each of the bags 15 has first 20 and second 25 parallel linear side edges, a top edge 30 and a bottom edge 35. The bags 15 are joined along a perforated severance line 40 between the bottom edge 35 of a first bag 50 and the top edge 30 of a subsequent bag 58. The bags 15 are rolled about a horizontal axis 75 to form a bag roll 65 from which the bags 15 are dispensed. The bag roll 65 has a first predetermined width 80 narrower than a distance 109 between the side panels. When the bag roll 65 is located within the dispenser 85 with the first bag 50 is accessible for withdrawal from the dispenser 85, the bags 15 may be serially withdrawn from the roll 65 with each subsequent bag 58 being parted at the perforated severance line 40.

(11) In still another variant, as illustrated in FIG. 2, means 130 for directing the bags 15 from the bag roll 65 over the perforation parting means 110 are provided.

(12) In yet another variant, the perforation parting means 110 extends outwardly beyond the bag roll restraining means 90.

(13) In a further variant, as illustrated in FIG. 7, each bag further includes a chisel cut 555, the chisel cut 555 penetrates the perforated severance line 40 and is located thereon so as to align with the perforation parting means 110 of the dispenser 85.

(14) In still a further variant, as illustrated in FIG. 8, the perforated severance line 40 is formed of a series of alternating cuts 560 and perforations 565, at least one of the cuts 560 is located so as to align with the perforation parting means 110.

(15) In yet a further variant, as illustrated in FIGS. 4-8, each of the bags 15 is folded along at least one axis 60 parallel to the first 20 and second 25 parallel linear side edges.

(16) In another variant of the invention, elements that make up the frame 87 are substantially circular in cross-section.

(17) In still another variant, elements making up the frame 87 are substantially rectangular in cross-section.

(18) In a final variant, elements making up the frame 87 are substantially triangular in cross-section.

The invention claimed is:

1. A dispensing system comprising:

a wire frame;

a lower bag roll support;

a constraining movement element;

a bag roll restraining means; and a perforation parting means;

wherein said frame includes four corners each of approximately 90 degrees, has a C shape in a horizontal plane, and includes a dispensing end, a back end, and two sides;

said lower bag roll support includes a proximal end and a distal end, said distal end is attached to said back end of said frame, and said lower bag roll support extends angularly downward from said distal end toward said proximal end;

said constraining movement element is attached to said two sides of said wire frame, and has two, approximately 90 degree angles that form side panels;

adjacent to said proximal end of said lower bag roll support said bag roll restraining means is attached to both of said sides of said frame, said perforation parting means is disposed adjacent said proximal end;

a plurality of plastic bags, each of said bags having first and second parallel linear side edges, a top edge and a bottom edge;

said bags being joined along a perforated severance line between said bottom edge of a first bag and said top edge of a subsequent bag;

said bags being rolled about a horizontal axis to form a bag roll from which said bags are dispensed, said bag roll having a first predetermined width narrower than a distance between said side panels;

whereby, when said bag roll is disposed within said dispenser with said first bag being accessible for withdrawal from said dispenser, said bags may be serially withdrawn from said roll with each subsequent bag being parted at said perforated severance line.

2. The dispensing system, as described in claim 1 further comprising means for directing said bags from said bag roll over said perforation parting means.

3. The dispensing system, as described in claim 1 wherein said perforation parting means extends outwardly beyond said bag roll restraining means.

4. The dispensing system, as described in claim 1, wherein each bag further comprises a chisel cut, said chisel cut penetrating said perforated severance line and being disposed thereon so as to align with said perforation parting means of said dispenser.

5. The dispensing system, as described in claim 1, wherein said perforated severance line is formed of a series of alternating cuts and perforations, at least one of said cuts being disposed so as to align with said perforation parting means.

6. The dispensing system, as described in claim 1 wherein each of said bags is folded along at least one axis parallel to said first and second parallel linear side edges.

7. The dispensing system, as described in claim 1, wherein elements comprising said frame are substantially circular in cross-section.

8. The dispensing system, as described in claim 1, wherein elements comprising said frame are substantially rectangular in cross-section.

9. The dispensing system, as described in claim 1, wherein elements comprising said frame are substantially triangular in cross-section.

10. A dispensing system comprising:

a wire frame;

a lower bag roll support;

a constraining movement element;

a bag roll restraining means; and a perforation parting means;

wherein said frame includes four corners each of approximately 90 degrees, has a C shape in a horizontal plane, and includes a dispensing end, a back end, and two sides;

said lower bag roll support includes a proximal end and a distal end, the distal end includes a plurality of angled corners, said distal end is attached to said back end of said frame, and said lower bag roll support extends angularly downward from said distal end toward said proximal end;

said constraining movement element is attached to said two sides of said wire frame, and has two, approximately 90 degree angles that form side panels;

adjacent to said proximal end of said lower bag roll support said bag roll restraining means is attached to said frame, said perforation parting means is disposed adjacent said proximal end;

a plurality of plastic bags, each of said bags having first and second parallel linear side edges, a top edge and a bottom edge;

said bags being joined along a perforated severance line between said bottom edge of a first bag and said top edge of a subsequent bag;

said bags being rolled about a horizontal axis to form a bag roll from which said bags are dispensed, said bag roll having a first predetermined width narrower than a distance between said side panels;

whereby, when said bag roll is disposed within said dispenser with said first bag being accessible for withdrawal from said dispenser, said bags may be serially withdrawn from said roll with each subsequent bag being parted at said perforated severance line.

11. The dispensing system, as described in claim 10 further comprising means for directing said bags from said bag roll over said perforation parting means.

12. The dispensing system, as described in claim 10 wherein said perforation parting means extends outwardly beyond said bag roll restraining means.

13. The dispensing system, as described in claim 10, wherein each bag further comprises a chisel cut, said chisel cut penetrating said perforated severance line and being disposed thereon so as to align with said perforation parting means of said dispenser.

14. The dispensing system, as described in claim 10, wherein said perforated severance line is formed of a series of alternating cuts and perforations, at least one of said cuts being disposed so as to align with said perforation parting means.

15. The dispensing system, as described in claim 10 wherein each of said bags is folded along at least one axis parallel to said first and second parallel linear side edges.

16. The dispensing system, as described in claim 10, wherein elements comprising said frame are substantially circular in cross-section.

17. The dispensing system, as described in claim 10, wherein elements comprising said frame are substantially rectangular in cross-section.

18. The dispensing system, as described in claim 10, wherein elements comprising said frame are substantially triangular in cross-section.

* * * * *